US009256182B2

(12) United States Patent
Cho et al.

(10) Patent No.: US 9,256,182 B2
(45) Date of Patent: Feb. 9, 2016

(54) IMAGE FORMING APPARATUS AND METHOD OF CONTROLLING THE SAME

(71) Applicant: SAMSUNG ELECTRONICS CO., LTD., Suwon-si, Gyeonggi-do (KR)

(72) Inventors: Hyun Ki Cho, Yongin-si (KR); Sang Bum Woo, Yongin-si (KR); Jae Il Yu, Hwaseong-si (KR); Soo Yong Kim, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/533,423

(22) Filed: Nov. 5, 2014

(65) Prior Publication Data

US 2015/0125188 A1 May 7, 2015

(30) Foreign Application Priority Data

Nov. 5, 2013 (KR) ..... 10-2013-0133734

(51) Int. Cl.
*G03G 15/01* (2006.01)
*G03G 15/00* (2006.01)

(52) U.S. Cl.
CPC .... *G03G 15/5058* (2013.01); *G03G 2215/0132* (2013.01); *G03G 2215/0161* (2013.01)

(58) Field of Classification Search
CPC ..... G03G 15/1605; G03G 15/5058; G03G 2215/0158; G03G 2215/0161
USPC ..... 399/301, 72; 347/116
See application file for complete search history.

(56) References Cited

U.S. PATENT DOCUMENTS

| | | | | |
|---|---|---|---|---|
| 7,773,925 | B2 * | 8/2010 | Ikeda | 399/301 |
| 8,004,546 | B2 * | 8/2011 | Miyadera | 347/116 |
| 8,035,667 | B2 * | 10/2011 | Miyadera | 347/116 |
| 2013/0195518 | A1 * | 8/2013 | Kumada et al. | 399/301 |
| 2014/0169842 | A1 * | 6/2014 | Nakashima | 399/301 |

* cited by examiner

*Primary Examiner* — Sophia S Chen
(74) *Attorney, Agent, or Firm* — Staas & Halsey LLP

(57) ABSTRACT

An image forming apparatus, a color registration test pattern of the image forming apparatus, and a method of forming the color registration test pattern are provided. A time required for color registration may be reduced by minimizing a region in which a color registration test pattern is formed on an intermediate transfer body. A control method of the image forming apparatus, which includes photosensitive media arranged side by side to correspond to colors in a rotation direction of the intermediate transfer body, includes forming first patterns of the colors arranged in a single row in a sub-scanning direction in a first region of the intermediate transfer body over a single-rotation period of the photosensitive media, and forming second patterns of the colors arranged in a single row in the sub-scanning direction in a second region of the intermediate transfer body over another single-rotation period of the photosensitive media.

37 Claims, 11 Drawing Sheets

IMAGE FORMING APPARATUS AND METHOD OF CONTROLLING THE SAME

CROSS-REFERENCE TO RELATED APPLICATIONS

This application is related to, and claims the priority benefit of Korean Patent Application No. 10-2013-0133734, filed on Nov. 5, 2013 in the Korean Intellectual Property Office, the disclosure of which is incorporated herein by reference.

BACKGROUND

1. Field

Embodiments relate to an image forming apparatus, and more particularly, to color registration or color correction of the image forming apparatus.

2. Description of the Related Art

An image forming apparatus of an electrophotographic system such as a laser printer, a digital copier, or the like is an apparatus in which a photosensitive medium charged to prescribed potential is irradiated with light to form an electrostatic latent image on the surface of the photosensitive medium. A toner that is a developing agent is supplied to the electrostatic latent image to develop the electrostatic latent image into a visible image, and then the developed visible image may be transferred to a paper sheet to print the image.

In a case in which images of different colors are superimposed on each other in a color image forming apparatus, deterioration in quality of the image, such as at the edges of the image appearing to be blurred, and the like may occur when the images of the respective colors are not superimposed in a correct position. Since the deterioration in quality of the image may occur by a complex action of several variables such as replacement of a developer, an increase in the number of printed sheets, and the like, color registration that arranges images of the respective colors so as to be superimposed in a correct position is required.

In the related art, a separate additional working time other than a time allotted to printing work is required in order to determine positional deviation for each color or to arrange colors based on the positional deviation, and therefore efficiency of the printing work is decreased.

SUMMARY

Therefore, it is an aspect of an exemplary embodiment to provide an image forming apparatus that may reduce a time required for color registration by minimizing a region in which a color registration test pattern is formed on an intermediate transfer body, and a method of controlling the same.

It is an aspect of an exemplary embodiment to provide an image forming apparatus that may simultaneously perform correction of color registration and correction of color density by forming a color density test pattern together with a color registration test pattern on an intermediate transfer body, thereby reducing a time required for the correction of color registration and the correction of color density, and a method of controlling the same.

It is an aspect to provide an image forming apparatus that may increase accuracy by reducing an error of color registration by improving a color registration test pattern.

Additional aspects are be set forth in part in the description that follows and, in part, will be obvious from the description, or may be learned by practice of the invention.

In accordance with an aspect of an exemplary embodiment, a control method of an image forming apparatus that includes a plurality of photosensitive media arranged side by side to correspond to a plurality of colors in a rotation direction of an intermediate transfer body is provided, the control method including forming a plurality of first patterns of the plurality of colors arranged in a single row in a sub-scanning direction in a first region of the intermediate transfer body over a single-rotation period of the photosensitive media, and forming a plurality of second patterns of the plurality of colors arranged in a single row in the sub-scanning direction in a second region of the intermediate transfer body over another single-rotation period of the photosensitive media.

A forming of the plurality of first patterns may include repeatedly forming first unit patterns of the plurality of colors in a preset order, and the forming of the plurality of second patterns may include repeatedly forming second unit patterns of the plurality of colors in a preset order.

A forming of the plurality of first patterns may include repeatedly forming the first unit patterns of the plurality of colors at least twice, and the forming of the plurality of second patterns may include repeatedly forming the second unit patterns of the plurality of colors at least twice.

A plurality of colors may include black, cyan, magenta, and yellow.

A forming of the plurality of first patterns may include forming the plurality of first patterns at uniform intervals, and the forming of the plurality of second patterns may include forming the plurality of second patterns at uniform intervals.

The first patterns may be patterns for color arrangement in the sub-scanning direction.

The first patterns may be bar-patterns that are formed long in a main-scanning direction.

The second patterns may be patterns for color arrangement in the main-scanning direction.

The second patterns may be slant patterns that are formed to be inclined in the sub-scanning direction.

In accordance with an aspect of an exemplary embodiment, a control method of an image forming apparatus that includes a plurality of photosensitive media arranged side by side to correspond to a plurality of colors in a rotation direction of an intermediate transfer body is provided, the control method including forming a plurality of first patterns of the plurality of colors arranged in a single row in a sub-scanning direction in a first region of the intermediate transfer body over a single-rotation period of the photosensitive media, forming a plurality of second patterns of the plurality of colors arranged in a single row in the sub-scanning direction in a second region of the intermediate transfer body over another single-rotation period of the photosensitive media; and alternately forming the plurality of first patterns and the plurality of second patterns over a four-rotation period of the photosensitive media.

The forming of the plurality of first patterns may include repeatedly forming first unit patterns of the plurality of colors in a preset order, and the forming of the plurality of second patterns may include repeatedly forming second unit patterns of the plurality of colors in a preset order.

The forming of the plurality of first patterns may include repeatedly forming the first unit patterns of the plurality of colors at least twice, and the forming of the plurality of second patterns may include repeatedly forming the second unit patterns of the plurality of colors at least twice.

The plurality of colors may include black, cyan, magenta, and yellow.

The forming of the plurality of first patterns may include forming the plurality of first patterns at uniform intervals, and the forming of the plurality of second patterns may include forming the plurality of second patterns at uniform intervals.

The first patterns may be patterns for color arrangement in the sub-scanning direction.

The first patterns may be bar-patterns that are formed long in a main-scanning direction.

The second patterns may be patterns for color arrangement in the main-scanning direction.

The second patterns may be slant patterns that are formed to be inclined in the sub-scanning direction.

In accordance an aspect of an exemplary embodiment, a control method of an image forming apparatus that includes a plurality of photosensitive media arranged side by side to correspond to a plurality of colors in a rotation direction of an intermediate transfer body is provided, the control method including forming a plurality of first patterns of the plurality of colors arranged in a single row in a sub-scanning direction in a first region of the intermediate transfer body over a two-rotation period of the photosensitive media, and forming a plurality of second patterns of the plurality of colors arranged in a single row in the sub-scanning direction in a second region of the intermediate transfer body over another two-rotation period of the photosensitive media.

The forming of the plurality of first patterns may include repeatedly forming first unit patterns of the plurality of colors in a preset order, and the forming of the plurality of second patterns may include repeatedly forming second unit patterns of the plurality of colors in a preset order.

The forming of the plurality of first patterns may include repeatedly forming the first unit patterns of the plurality of colors at least twice, and the forming of the plurality of second patterns may include repeatedly forming the second unit patterns of the plurality of colors at least twice.

The plurality of colors may include black, cyan, magenta, and yellow.

The forming of the plurality of first patterns may include forming the plurality of first patterns at uniform intervals, and the forming of the plurality of second patterns may include forming the plurality of second patterns at uniform intervals.

The first patterns may be patterns for color arrangement in the sub-scanning direction.

The first patterns may be bar-patterns that are formed long in a main-scanning direction.

The second patterns may be patterns for color arrangement in the main-scanning direction.

The second patterns may be slant patterns that are formed to be inclined in the sub-scanning direction.

In accordance an aspect of an exemplary embodiment, a control method of an image forming apparatus that includes a plurality of photosensitive media arranged side by side to correspond to a plurality of colors in a rotation direction of an intermediate transfer body is provided, the control method including forming a plurality of first patterns of the plurality of colors arranged in a single row in a sub-scanning direction in a first region of the intermediate transfer body over a single-rotation period of the photosensitive media, forming a plurality of second patterns of the plurality of colors arranged in a single row in the sub-scanning direction in a second region of the intermediate transfer body over another single-rotation period of the photosensitive media, alternately forming the plurality of first patterns and the plurality of second patterns over a four-rotation period of the photosensitive media; and forming a color density test pattern side by side with the plurality of first patterns or the plurality of second patterns in the sub-scanning direction.

The forming of the plurality of first patterns may include repeatedly forming first unit patterns of the plurality of colors in a preset order, and the forming of the plurality of second patterns may include repeatedly forming second unit patterns of the plurality of colors in a preset order.

The forming of the plurality of first patterns may include repeatedly forming the first unit patterns of the plurality of colors at least twice, and the forming of the plurality of second patterns may include repeatedly forming the second unit patterns of the plurality of colors at least twice.

The plurality of colors may include black, cyan, magenta, and yellow.

The forming of the plurality of first patterns may include forming the plurality of first patterns at uniform intervals, and the forming of the plurality of second patterns may include forming the plurality of second patterns at uniform intervals.

The first patterns may be patterns for color arrangement in the sub-scanning direction.

The first patterns may be bar-patterns that are formed long in a main-scanning direction.

The second patterns may be patterns for color arrangement in the main-scanning direction.

The second patterns may be slant patterns that are formed to be inclined in the sub-scanning direction.

In accordance with further aspect, there is provided a control method of an image forming apparatus including: forming a plurality of first patterns of a plurality of colors arranged in a single row in a sub-scanning direction in a first region of an intermediate transfer body over at least a single-rotation period of photosensitive media; and forming a plurality of second patterns of the plurality of colors arranged in a single row in the sub-scanning direction in a second region of the intermediate transfer body over at least another single-rotation period of the photosensitive media.

In accordance with an aspect, an image forming apparatus including an intermediate transfer body in which an image is formed; a plurality of photosensitive media that are arranged side by side to correspond to a plurality of colors in a rotation direction of the intermediate transfer body, and a control unit that controls the intermediate transfer body and the plurality of photosensitive media so that a plurality of first patterns of the plurality of colors arranged in a single row in a sub-scanning direction are formed in a first region of the intermediate transfer body over at least a single-rotation period of the photosensitive media and a plurality of second patterns of the plurality of colors arranged in a single row in the sub-scanning direction are formed in a second region of the intermediate transfer body over at least another single-rotation period of the photosensitive media.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
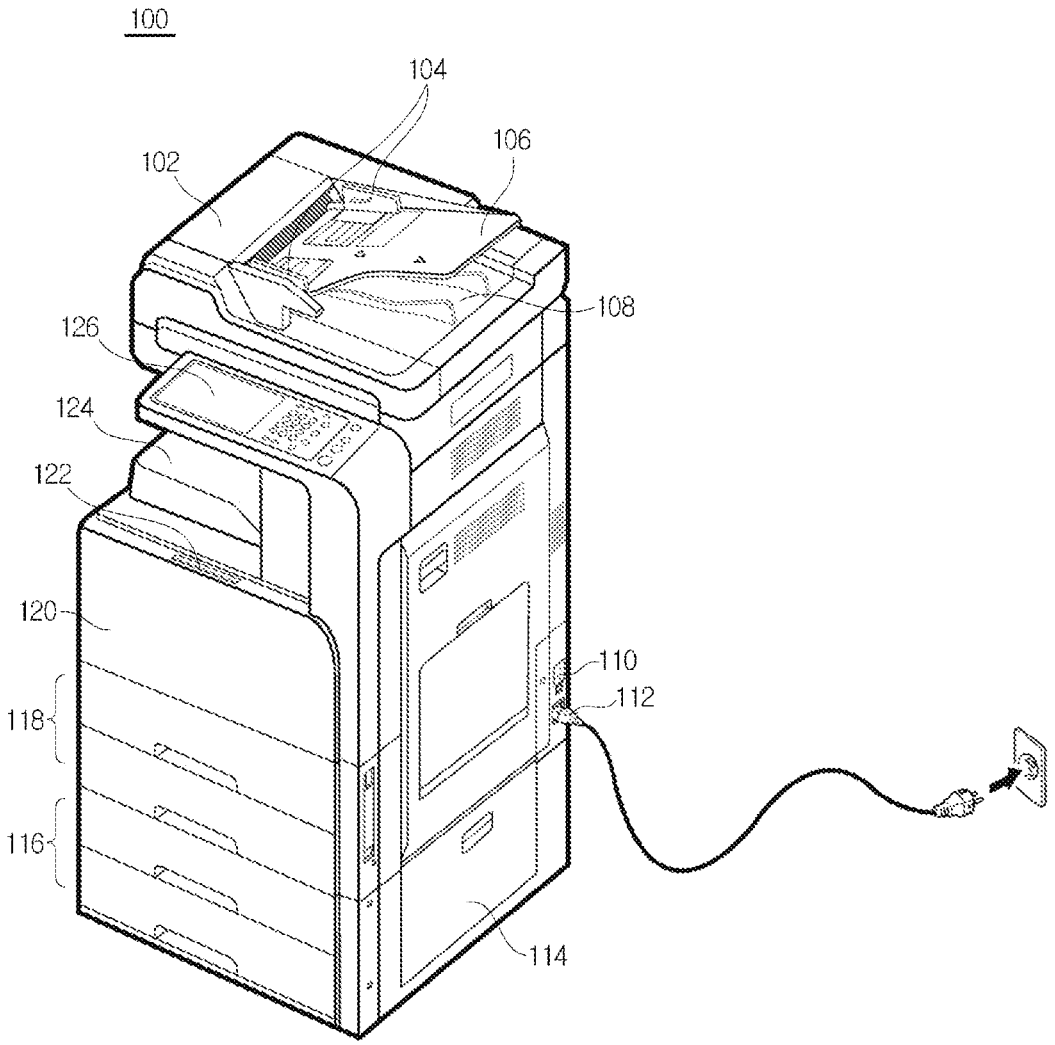
FIG. 1 illustrates an image forming apparatus in accordance with an embodiment.

Reference will now be made in detail to the embodiments, examples of that are illustrated in the accompanying drawings, wherein like reference numerals refer to like elements throughout.

Hereinafter, embodiments are described in detail.

FIG. 1 illustrates an image forming apparatus in accordance with an embodiment. As illustrated in FIG. 1, an image forming apparatus 100 may be configured as below when viewed from the outside.

An automatic document feeder 102 may be provided in an upper portion of the image forming apparatus 100. The automatic document feeder 102 is a device that may be added by selection of an option, and may be removed from the image forming apparatus 100. The automatic document feeder 102 supplies a quantity of documents to the image forming apparatus 100 per sheet. For example, in a case of scanning/copying/sending (faxing) a quantity of documents, when supplying the documents using the automatic document feeder 102, it is possible to supply a quantity of documents to the image forming apparatus 100 in a short time. In the automatic document feeder 102, a document width guide 104, a document feeding tray 106, and a document output tray 108 are provided. The document width guide 104 guides documents to be supplied at both sides of the documents (in a main-scanning direction) so that the documents can be supplied into the image forming apparatus 100 in a designated direction while being kept in a constant posture. The document feeding tray 106 may be used for storing the documents to be supplied inside the image forming apparatus 100. The documents stored in the document feeding tray 106 may be supplied into the image forming apparatus 100 by an action of a paper pick-up means, a roller, or the like. The document output tray 108 is a place in which the documents are supplied into the image forming apparatus 100 from the document feeding tray 106, subjected to a scanning process inside the image forming apparatus 100, and then discharged from the image forming apparatus 100 to be stored.

A power switch 110 may be provided, for example, on a right side surface of the image forming apparatus 100. The power switch 110 enables a phase/voltage/frequency, or the like of alternating current (AC) power of 110V or 220V supplied through a power code 112 to be converted through a power supply unit of the image forming apparatus 100 to be supplied to each electric component of the image forming apparatus 100.

A second cassette cover 114 is a cover that may be provided on a side surface of a second cassette feeder 116. The second cassette feeder 116 may be selectively mounted in addition to a standard cassette feeder 118 that is basically provided in the image forming apparatus 100 for receiving paper sheets. The second cassette feeder 116 greatly increases a paper storing capacity together with the standard cassette feeder 118.

A front cover 120 is a cover that may be provided on a front surface of the image forming apparatus 100. When opening the front cover 120, a laser scanning unit, a waste toner case, a toner cartridge, an imaging unit, and the like can be maintained. The front cover 120 may be opened through a front cover handle 122.

A paper output tray 124 is a place in which paper sheets that are supplied to the image forming apparatus 100, on which an image is formed, and then which are discharged, are stored.

An operation unit 126 includes a display unit, a status light emitting diode (LED), and a key input unit. The key input unit includes a plurality of numeral buttons and function buttons, a menu button, and a command button.

Figure 2:
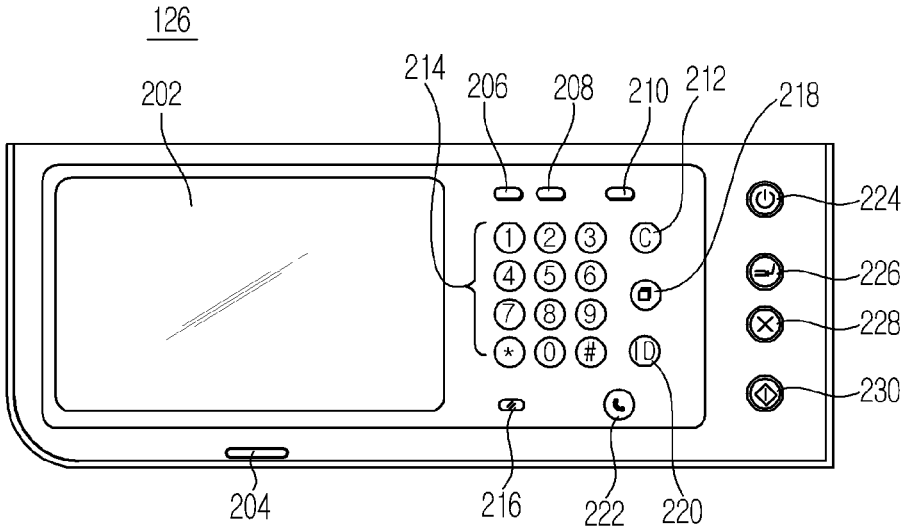
FIG. 2 illustrates an operation unit of an image forming apparatus in accordance with an embodiment.

FIG. 2 illustrates an operation unit of an image forming apparatus in accordance with an embodiment. As illustrated in FIG. 2, the operation unit 126 of the image forming apparatus in accordance with an embodiment includes a display unit 202, a status display LED 204, an operation status button 206, a counter button 208, an eco button 210, a deletion button 212, a numeral button 214, a function return button 216, a redial/pause button 218, a login/logout button 220, an on-hook dial button 222, a power supply button 224, an urgent copy button 226, a pause button 228, and a start button 230.

The display unit 202 displays a current status of the image forming apparatus 100, and a screen that requires a user's response may be displayed on the display unit 202 during operation. Menus can be set in the display unit 202.

The status display LED 204 displays a status, for example, current status of the image forming apparatus 100 through a change in colors and blinking. An exemplary difference between the display unit 202 and the status display LED 204 is that the display unit 202 can display specific status information and bilaterally communicate with the user, but the status display LED 204 simply and unilaterally displays the status of the image forming apparatus 100, for example, through the change in colors and blinking.

The operation status button 206 displays, on the display unit 202, for example, a currently performed operation, a standby operation, a completed operation, a generated error code, or a security operation in the image forming apparatus 100 in response to the user's operation.

The counter button 208 displays the number of accumulated paper sheets that is used in the image forming apparatus 100 in response to the user's operation.

The eco button 210 enables the image forming apparatus 100 to forcedly enter a power-saving mode (eco mode) for saving energy in response to the user's operation.

The deletion button 212 deletes letters/numeral numbers/signs, and the like from an editing area in response to the user's operation. For example, when an erroneous input is made while the number of paper sheets to be copied is being input, the deletion button 212 may be used to correct the erroneous input. When an erroneous input is made while a reception fax number is being input for fax transmission, the deletion button 212 may be used to correct the erroneous input.

The numeral button 214 enables the user to press telephone/fax numbers or to input other numeral numbers and letters. The number of paper sheets to be printed or numeral values of other options can be input.

The function return button 216 initializes a current setting of the image forming apparatus 100 in response to the user's operation. For example, when the number of paper sheets to be copied and a value of copy density (darkness) are set in a status in which a copy menu is selected, the number of paper sheets to be copied is initialized to 0 and the copy density (darkness) may be initialized to an intermediate value by pressing the function return button 216.

The redial/pause button 218 redials a recently sent fax number or the other party's number in a standby mode, or inserts a pause (–) into the fax number in an editing mode in response to the user's operation.

The login/logout button 220 enables the user to log in or log out of the image forming apparatus 100 in response to the user's operation.

The on-hook dial button 222 enables a dial tone to sound in response to the user's operation.

The power supply button 224 may turn on or off power of the image forming apparatus 100. When the status display LED 204 is turned on in blue, the power of the image forming apparatus 100 is in a turned-on state. To turn off the power of the image forming apparatus 100, the power supply button 224 should be pressed for three seconds or longer.

Another operation that is currently performed can be stopped for urgent copy through an operation of the urgent copy button 226.

The pause button 228 pauses an operation that is currently performed in the image forming apparatus 100 in response to the user's operation. A pop-up window that shows a current operation status is displayed on the display unit 202 so that the user can select pause/restart.

The start button 230 enables a currently set operation to start in response to the user's operation.

Figure 3:
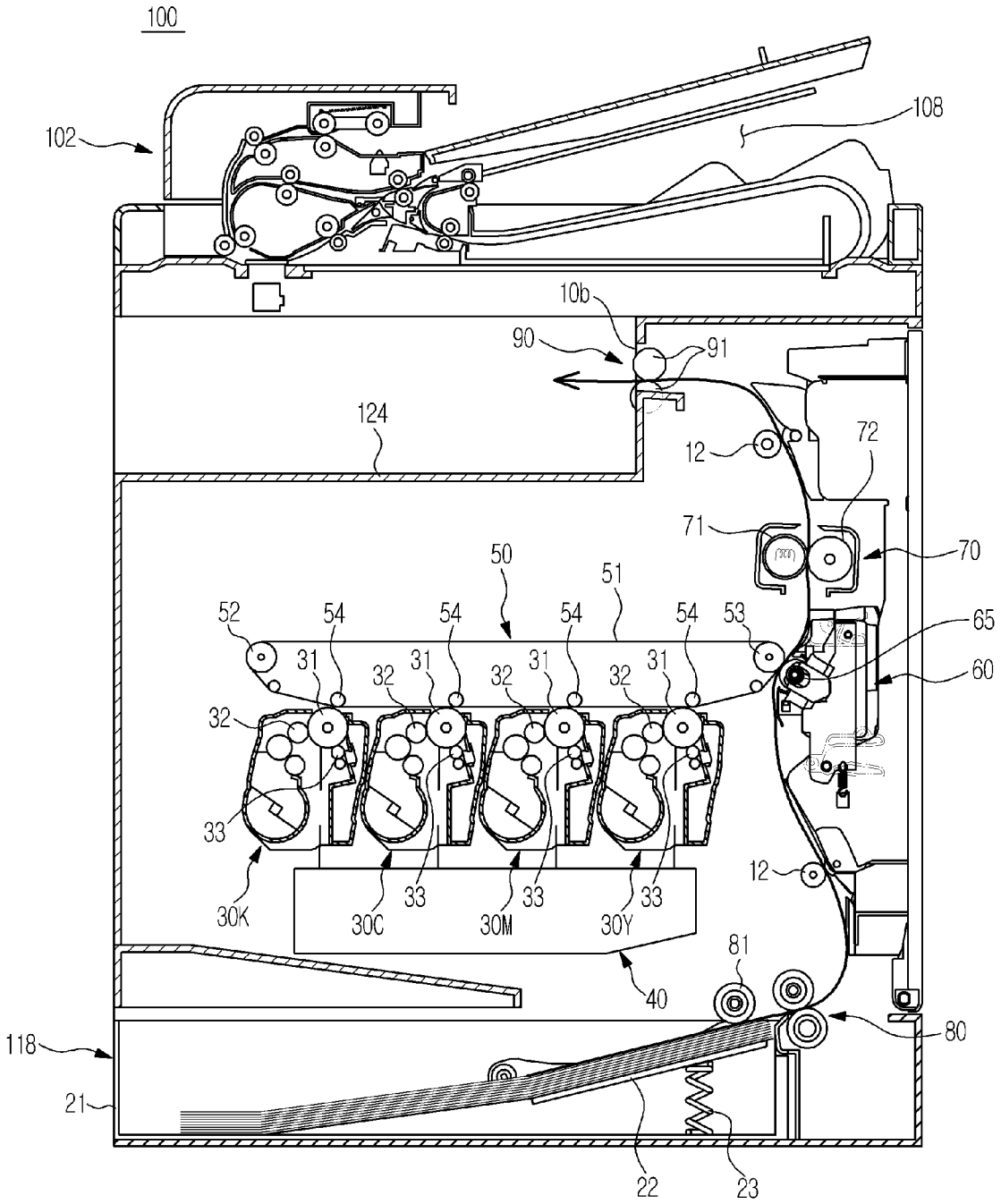
FIG. 3 illustrates an internal structure of an image forming apparatus in accordance with an embodiment.

FIG. 3 illustrates an internal structure of an image forming apparatus in accordance with an embodiment. The image forming apparatus 100 in accordance with an embodiment includes a plurality of developing units 30C, 30M, 30Y, and 30K that develop an electrostatic latent image as a visible image in accordance with colors through a developing agent (for example, a tonner), an exposure unit 40 that forms the electrostatic latent image by scanning light to a photosensitive medium 31 of the developing units 30C, 30M, 30Y, and 30K that are charged, transfer devices 50 and 60 that receive paper sheets from the standard cassette feeder 118 and transfer the visible image formed on the photosensitive medium 31 to a printing medium, and a fixing unit 70 that fixes the developing agent transferred to the paper sheets on the paper sheets (see 306 of FIG. 4).

A paper discharging opening 10*b* through which paper sheets on which formation of an image is completed are discharged may be provided on one side of the paper output tray 124.

Inside the standard cassette feeder 118, a tray 21, a knock-up plate 22 that is disposed inside the tray 21 and on which paper sheets are loaded, and an elastic member 23 that elastically supports the knock-up plate 22 may be provided.

Each of the developing units 30C, 30M, 30Y, and 30K includes the photosensitive medium 31 in which the electrostatic latent image is formed on a discharged surface by the exposure unit 40, a developing roller 32 that supplies the developing agent to the photosensitive medium 31, and a charging roller 33 that charges a surface of the photosensitive medium 31.

According to an exemplary embodiment, the developing units 30C, 30M, 30Y, and 30K include four developing units 30C, 30M, 30Y, and 30K in which any one of developing agents of cyan (C), magenta (M), yellow (Y), and black (K) colors is stored to develop the respective cyan (C), magenta (M), yellow (Y), and black (K) colors. The four developing units 30C, 30M, 30Y, and 30K may be arranged side by side below the transfer devices 50 and 60.

The exposure unit 40 irradiates light including image information on the photosensitive media 31 provided in each of the developing units 30C, 30M, 30Y, and 30K to form the electrostatic latent image on each surface of the photosensitive media 31.

The transfer devices 50 and 60 include a first transfer unit 50 to which the visible image formed from the developing units 30C, 30M, 30Y, and 30K by the developing agent is transferred, and a second transfer unit 60 that enables the visible image on the first transfer unit 50 to be transferred to the paper sheet. The second transfer unit 60 includes a transfer roller 65.

The fixing unit 70 includes a heating roller 71 that generates heat and a pressure roller 72 whose outer circumferential surface is made of an elastically deformable material to pressure an outer circumferential surface of the heating roller 71.

A pick-up unit 80 that is disposed in an upper portion of the standard cassette feeder 118 to pick up paper sheets loaded on the knock-up plate 22 one sheet by one sheet, transporting rollers 12 that guide the paper sheets picked up by the pick-up unit 80 to an upper side, and a paper discharging unit 90 that is disposed on an upper side of the fixing unit 70 in the vicinity of the paper discharging opening 10*b* to enable the paper sheets having passed through the fixing unit 70 to be discharged through the paper discharging opening 10*b*.

The pick-up unit 80 includes a pick-up roller 81 that picks up the paper sheets on the knock-up plate 22 one sheet by one sheet, and the paper discharging unit 90 includes a pair of paper discharging rollers 91 that are disposed inside the paper discharging opening 10*b*.

In the image forming apparatus 100, the first transfer unit 50 may be rotatably provided in a transfer belt 51 that is an intermediate transfer body in which the developing agent developed as the visible image is superimposed and transferred on the photosensitive media 31 of the developing units 30C, 30M, 30Y, and 30K, a driving roller 52 and a driven roller 53 that are arranged on both inner sides of the transfer belt 51 so as to rotate the transfer belt 51, a plurality of rollers 54 that are arranged to face each of the photosensitive media 31 of the developing units 30C, 30M, 30Y, and 30K in a state in which the transfer belt 51 is interposed between the plurality of rollers 54 so as to enable the visible image formed on the photosensitive media 31 to be transferred to the transfer belt 51, and a transfer belt frame (not illustrated) in which both ends of the rollers 54, the driving roller 52, and the driven roller 53 are rotatably provided. The intermediate transfer body may use the transfer roller instead of the transfer belt 51.

Figure 4:
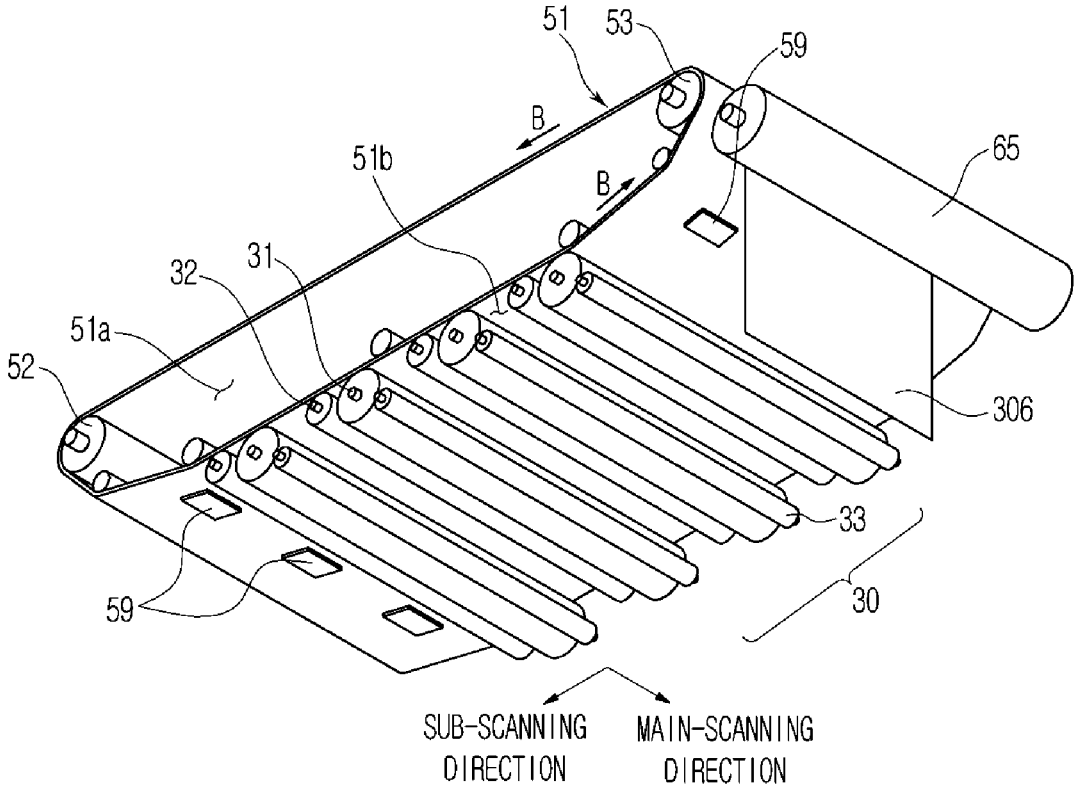
FIG. 4 illustrates a structure of a transfer belt and a developing unit of an image forming apparatus in accordance with an embodiment.

FIG. 4 illustrates a structure of a transfer belt and a developing unit of an image forming apparatus in accordance with an embodiment. The four developing units 30C, 30M, 30Y, and 30K that express four colors of C, M, Y, and K are provided in the image forming apparatus in accordance with an embodiment. As illustrated in FIG. 4, in each of the developing units 30, only of the photosensitive medium 31, the developing roller 32, and the charging roller 33 are illustrated, and other components of the developing unit 30 are omitted.

With reference to FIG. 4, an exemplary configuration of the transfer belt 51 is described. The transfer belt 51 having a closed loop shape may be hooked, in the form of a parallel hook, to the driving roller 52 and the driven roller 53 fixed and provided while being spaced apart from each other, and the transfer belt 51 has tension of a certain level or more by the driving roller 52 and the driven roller 53. The transfer belt 51 circularly travels in an arrow direction B along outer circumferential surfaces of the driving roller 52 and the driven roller 53 by rotation of the driving roller 52 and the driven roller 53.

Assuming that a surface of the transfer belt 51 that is in contact with the outer circumferential surfaces of the driving roller 52 and the driven roller 53 is an inner surface 51*a*, and the other surface thereof that is not in contact with the driving roller 52 and the driven roller 53 is an outer surface 51*b*, an image may be formed on the outer surface 51*b* of the transfer belt 51, or a formation region 304 in which an auto color registration (ACR) test pattern is formed is provided on the outer surface 51*b*.

The formation of the image in the transfer belt 51 denotes that an image desired to be printed on a paper sheet 306 is developed as a visible image through the developing agent (for example, toner). The formation of the ACR test pattern in the transfer belt 51 denotes that the ACR test pattern that is a test pattern for color position correction and color density correction is formed. A shape, an interval, and a color of the ACR test pattern may be detected by a test pattern detection unit 59 to be transmitted to a control unit (for example, a central processing unit (CPU)) of the image forming apparatus 100. The test pattern detection unit 59 includes a light emitting unit that irradiates light towards the outer surface 51*b* of the transfer belt 51 and a light receiving unit that receives light reflected and returned from the outer surface 51*b* of the transfer belt 51. The test pattern detection unit 59 may be used for detecting the shape, the interval, and the color of the ACR test pattern that is formed on the outer surface 51*b* of the transfer belt 51, and provided so as to be spaced apart from the outer surface 51*b* of the transfer belt 51 in a position where the ACR test pattern is formed on a moving trajectory of the transfer belt 51. The test pattern detection unit 59 can detect the shape, the interval, and the color of the ACR test pattern on the outer surface 51*b* of the transfer belt 51 while the transfer belt 51 is moving.

With reference to FIG. 4, a configuration of the developing unit 30 is described. In the developing unit 30 illustrated in FIG. 4, only the photosensitive medium 31, the developing roller 32, and the charging roller 33 are illustrated and the other components of the developing unit 30 are omitted. The photosensitive medium 31 may be rotatably installed while being slightly spaced apart from the outer surface 51*b* of the transfer belt 51. When forming the visible image or the ACR test pattern on the outer surface 51*b* of the transfer belt 51, the photosensitive medium 31 moves towards the transfer belt 51 to be brought into contact with the outer surface 51*b* of the transfer belt 51, whereby the visible image or the ACR test pattern is formed. The developing roller 32 and the charging roller 33 also move towards the transfer belt 51 together with the photosensitive medium 31. However, since the developing roller 32 and the charging roller 33 are not brought into contact with the outer surface 51*b* of the transfer belt 51, the developing roller 32 and the charging roller 33 may be coupled to the photosensitive medium 31 while being spaced apart farther than the photosensitive medium 31 from the outer surface 51*b* of the transfer belt 51.

The transfer roller 65 may be rotatably installed at a position adjacent to the driven roller 53 that supports an end of the transfer belt 51. That is, the transfer belt 51 passes through between the driven roller 53 and the transfer roller 65 while the transfer belt 51 circularly travels. The paper sheet 306 passes through between the outer surface 51*b* of the transfer belt 51 and the transfer roller 65. The transfer roller 65 enables the visible image formed on the outer surface 51*b* of the transfer belt 51 to be transferred to a surface of the paper sheet 306. That is, the transfer roller 65 enables the developing agent (for example, toner) formed on the outer surface 51*b* of the transfer belt 51 to be moved to the surface of the paper sheet 306 while the transfer belt 51 being circularly traveling and the paper sheet 306 is passing through between the transfer belt 51 and the transfer roller 65.

Figure 5:
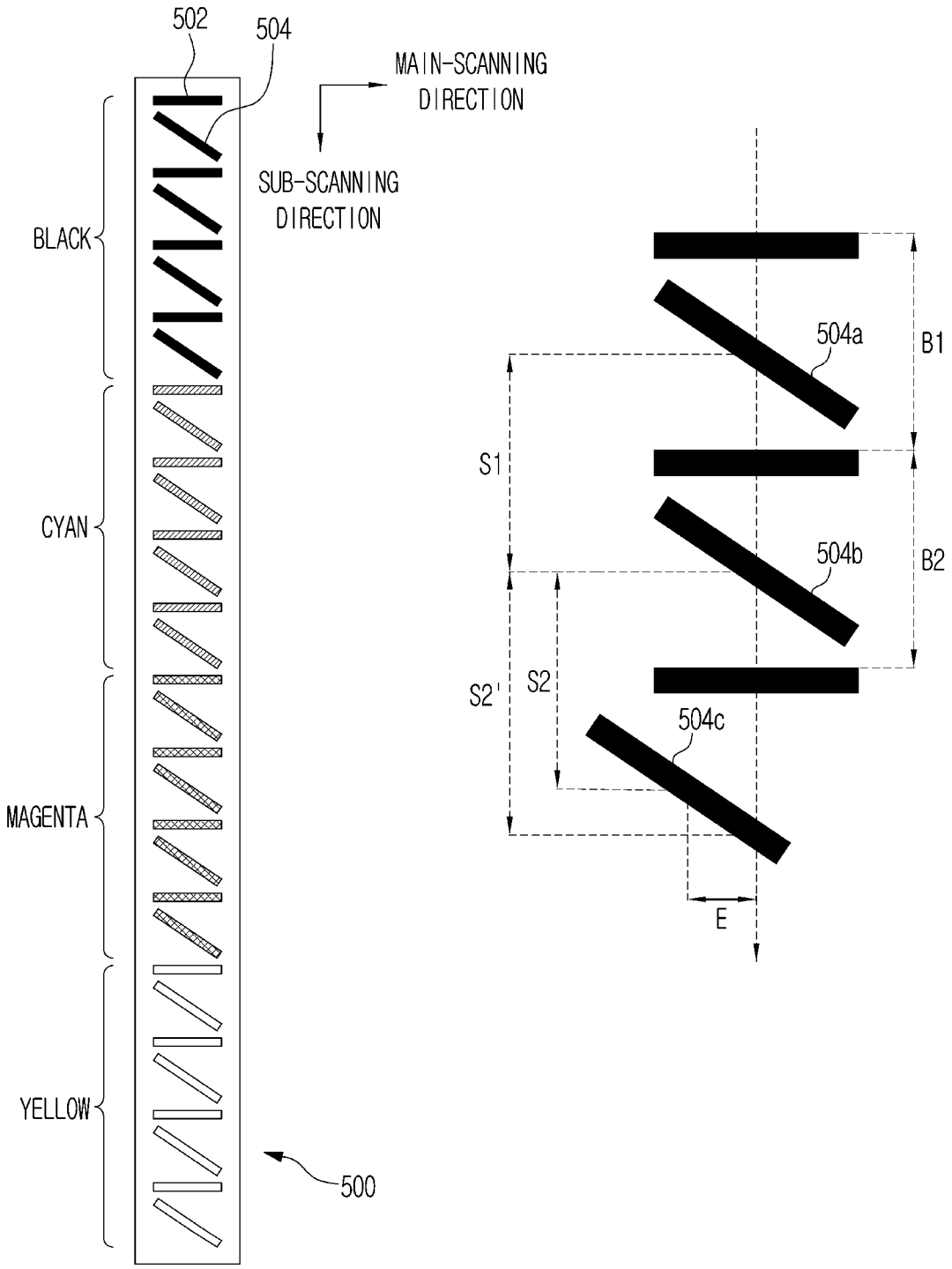
FIG. 5 illustrates a configuration and a principle of an automatic calling router (ACR) test pattern of an image forming apparatus in accordance with an embodiment.

FIG. 5 illustrates a configuration and a principle of an ACR test pattern of an image forming apparatus in accordance with an embodiment. As illustrated in the ACR test pattern 500 in FIG. 5, in the ACR test pattern for color printing, test patterns for each of black, cyan, magenta, and yellow colors are arranged in a main-scanning direction. A group is formed for each color in the ACR test pattern 500 in FIG. 5, but, a group may be formed so that a plurality of ACR test patterns for each color are mixed within a single group. The ACR test pattern 500 includes a bar pattern 502 and a slant pattern 504. The bar pattern 502 is a test pattern for color registration in a sub-scanning direction and the slant pattern 504 is a test pattern for color registration in the main-scanning direction.

The bar pattern 502 is arranged along and in parallel in the main-scanning direction and may be used for the color registration in the sub-scanning direction. That is, a plurality of bar patterns 502 may be formed on the outer surface 51*b* of the transfer belt 51 at preset intervals in the sub-scanning direction, distances B1 and B2 between the plurality of bar patterns 502 are measured through the test pattern detection unit 59, and whether each of the distances B1 and B2 between the actual bar patterns 502 coincides with the preset intervals that have been intended when forming the bar pattern 502 may be determined, thereby detecting a color registration error in the sub-scanning direction. When there is no the color registration error in the sub-scanning direction, a condition of "B1=B2=preset interval" may be satisfied. When the color registration error in the sub-scanning direction is detected, in order for the bar pattern 502 to be formed at the preset interval as intended, the error may be corrected. Such a series of error detection and correction processes may be referred to as ACR.

The slant pattern 504 may be arranged so as to be inclined at a preset angle (for example, 45 degrees) in the main-scanning direction, and used for color registration in the main-scanning direction. That is, a plurality of slant patterns 504 may be formed in a second region of the transfer belt 51 at the preset intervals in the scanning direction on the outer surface 51*b* of the transfer belt 51, distances between the plurality of bar patterns 502 are measured through the test pattern detection unit 59, and then whether the distance between the actual bar patterns 502 coincides with the preset intervals that have been intended when forming the bar pattern 502 is determined.

Since the slant pattern 504 is formed to be inclined at the preset angle (for example, 45 degrees), when the actual distance between the plurality of slant patterns 504 does not coincide with the preset intervals that have been intended when forming the slant pattern 504, this may mean that there is a color registration error in the main-scanning direction. In FIG. 5, a case in which a first slant pattern 504*a* and a second slant pattern 504*b* are arranged at the preset intervals without an error is illustrated. A distance S1 between the first slant pattern 504*a* and the second slant pattern 504*b* coincides with the present interval. However, when a third slant pattern 504*c* is formed while being one-sided to the left in the main-scanning direction, it can be found that an actual distance S2' between the second slant pattern 504*b* and the third slant pattern 504*c* is much larger than a preset interval S2. An error between S2 and S2' may be due to a degree E to which the third slant pattern 504*c* is one-sided in the main-scanning direction, and the error E is the color registration error in the main-scanning direction.

A series of processes that form an intended color in an intended position by correcting the color registration error in the sub-scanning direction or the main-scanning direction is referred to as automatic color registration (hereinafter, referred to as "ACR"). The ACR may be periodically performed whenever the number of accumulated paper sheets to be printed of the image forming apparatus 100 reaches a preset number of paper sheets to be printed, or non-periodically performed whenever a change in temperature/humidity around the image forming apparatus 100 is predicted to affect a printing quality.

More accurate error detection and correction may be performed along with an increase in the number of the bar patterns 502 and the slant patterns 504 of the ACR test pattern that is formed in order to perform one-time ACR, and therefore it is desirable that the number of the bar patterns 502 and the slant patterns 504 of the ACR test pattern be larger. However, since the slant pattern 504 may be formed to be inclined at the preset angle, when the bar pattern 502 and the slant pattern 504 are alternately formed as illustrated in FIG. 5, the slant pattern 504 occupies a space corresponding to the inclined angle. Thus, when a larger number of slant patterns 540 are formed in order to enhance accuracy of the error detection and correction, a region occupied by the slant pattern 504 on the transfer belt 51 is further required, and when a rotational speed of the transfer belt 51 is constant, more time for forming the larger number of slant patterns 504 is required. Thus, other printing operations cannot be performed while ACR is performed, which can act very disadvantageous from the viewpoint of high-speed printing.

Figure 6:
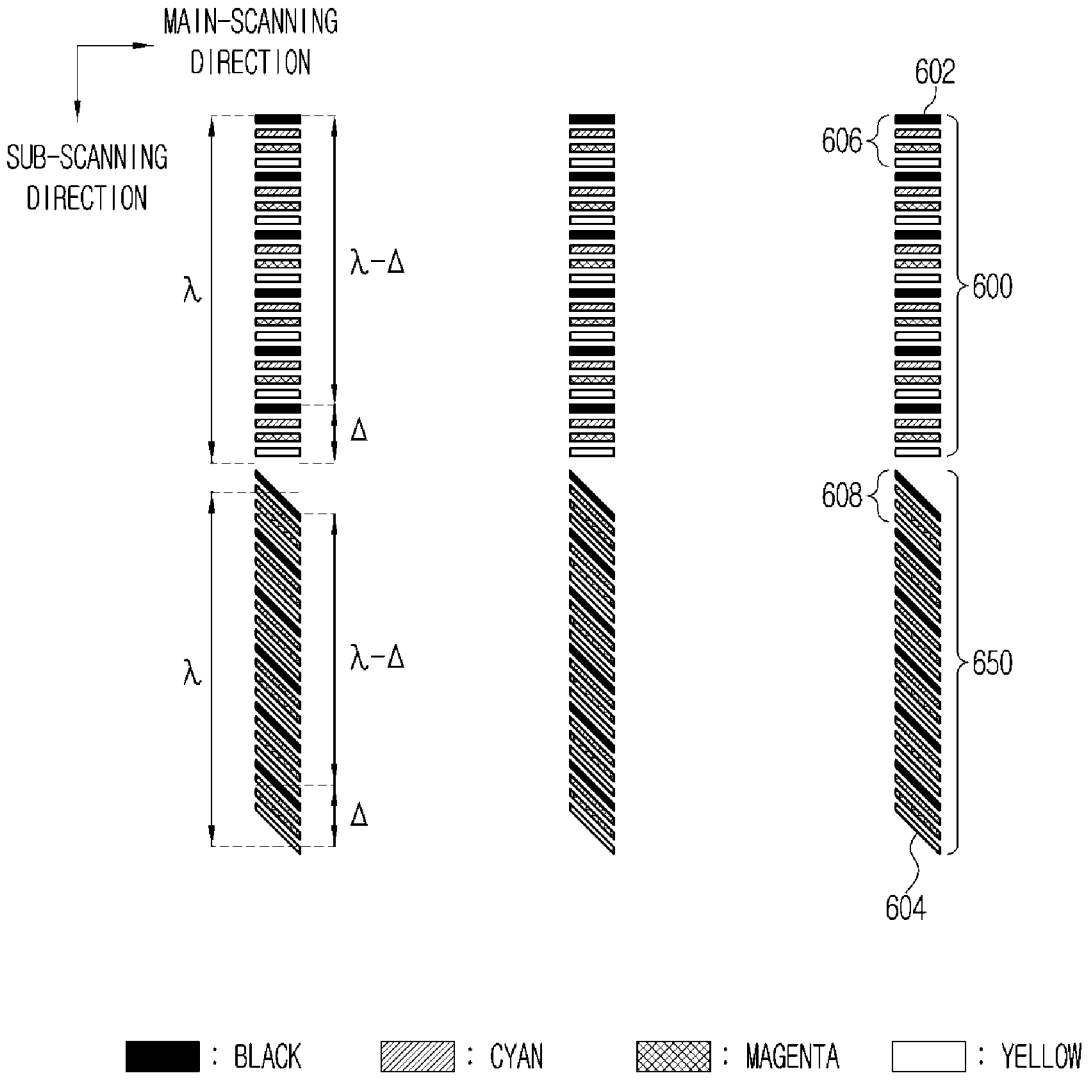
FIG. 6 illustrates an ACR test pattern in accordance with a first embodiment.

FIG. 6 illustrates an ACR test pattern in accordance with a first embodiment. In the ACR test pattern in accordance with the first embodiment illustrated in FIG. 6, a plurality of bar patterns 602 (first patterns) may be arranged in a single row at a preset interval in a sub-scanning direction to form a single bar pattern group 600, and subsequently, a plurality of slant patterns 604 (second patterns) may be arranged at a preset interval in the sub-scanning direction to form a single slant pattern group 650. The bar pattern group 600 may be formed in a first region of the transfer belt 51 over a single-rotation period (λ) of the photosensitive medium 31, and the slant pattern group 650 may be formed in a second region of the transfer belt 51 over another single-rotation period (λ) of the photosensitive medium 31, whereby an ACR test pattern is formed over a two-rotation period (2λ) of the photosensitive medium 31.

The single bar pattern group 600 includes at least one bar pattern set 606, and the single bar pattern set 606 includes at least one unit bar pattern 602 indicating each color of black, cyan, magenta, and yellow. The order in which the bar patterns 602 of black, cyan, magenta, and yellow colors are arranged for each bar pattern set 606 may be constant. The single slant pattern group 650 also includes at least one slant pattern set 608, and the single slant pattern set 608 includes at least one unit slant pattern 604 indicating respective colors of black, cyan, magenta, and yellow. The order in which the slant patterns 604 of black, cyan, magenta, and yellow colors are arranged for each slant pattern set 608 may be constant. The bar pattern 602 is a test pattern for color registration in the sub-scanning direction, and the slant pattern 604 is a test pattern for color registration in the main-scanning direction.

As illustrated in FIG. 6, the bar pattern group 600 includes only the plurality of bar patterns 602, and the slant pattern group 650 includes only the plurality of slant patterns 604. Thus, the slant pattern group 650 includes only the plurality of slant patterns 604, thereby significantly reducing an area occupied by the slant patterns 604 and a time required for forming the slant patterns 604. As illustrated in FIG. 5, since the slant pattern 604 is formed to be inclined at a preset angle, the slant patterns 604 cannot be formed so as to be superimposed by interference of the bar patterns 602 when the slant patterns 604 and the bar patterns 602 are alternately arranged, and therefore the slant patterns 604 may occupy a larger area corresponding to a degree of inclination. However, as illustrated in FIG. 6, when only the plurality of slant patterns 604 make up the slant pattern group 650, neighboring slant patterns 604 can be formed to be superimposed, and therefore intervals between the slant patterns 604 may be reduced, thereby significantly reducing an area occupied by the slant pattern group 650.

In FIG. 6, each of the single bar pattern group 600 or the single slant pattern group 650 in the sub-scanning direction has a length corresponding to a single-rotation period (λ) (or length of a circumference of the photosensitive medium 31) of the photosensitive medium 31. That is, the plurality of bar pattern sets 606 or the plurality of slant pattern sets 608 are formed over the entire single-rotation period (λ) (or length of the circumference of the photosensitive medium 31) of the photosensitive medium 31 at uniform intervals. In FIG. 6, since the plurality of bar pattern sets 606 or the plurality of slant pattern sets 608 are formed at uniform intervals during a 360-degree period corresponding to the single-rotation period (λ) (or length of the circumference of the photosensitive medium 31) of the photosensitive medium 31, positional values of the bar patterns 602 or the slant patterns 604 are measured at uniform intervals over the entire single-rotation period of the photosensitive medium 31 and an average value of the measured values may be obtained. When this occurs, color registration correction can be more accurately performed considering a periodic fluctuation component (for example, periodic fluctuation component caused by eccentricity or deviation of the rotational speed of the photosensitive medium 31, or the like), thereby significantly improving effects of ACR. When the bar pattern set 606 or the slant pattern set 608 is formed only in a partial section of the single-rotation period of the photosensitive medium 31, an average value of the positional values of the bar patterns 602 or the slant patterns 604 is calculated without considering the periodic fluctuation component over the entire single-rotation period of the photosensitive medium 31, and therefore an error having a size corresponding to the periodic fluctuation component that is not considered may not be corrected. However, in each of the bar pattern group 600 or the slant pattern group 650 of the ACR test pattern in accordance with the first embodiment illustrated in FIG. 6, an error can be measured considering even the periodic fluctuation component over the entire single-rotation period of the photosensitive medium 31, whereby more accurate error detection and correction can be achieved.

In FIG. 6, the plurality of bar patterns 602 of the bar pattern group 600 or the plurality of slant patterns 604 of the slant pattern group 650 are all formed at uniform intervals. Due to the uniform intervals, positions of the plurality of bar patterns 602 or the plurality of slant patterns 604 can be readily detected, and it is possible to readily implement a correction algorithm for performing color registration using position data of each of the plurality of bar patterns 602 or the plurality of slant patterns 604. That is, when the plurality of bar patterns 602 or the plurality of slant patterns 604 are not formed at mutually uniform intervals, the correction algorithm should be implemented considering all intervals that are not uniform, and therefore it is very difficult to implement the correction algorithm and an amount of computation is significantly increased. However, by forming the plurality of bar patterns 602 or the plurality of slant patterns 604 at mutually uniform intervals as illustrated in according to an exemplary embodiment, a simple correction algorithm having a small amount of computation may be easily implemented. In addition, it is possible to readily perform noise filtering. That is, in a case in which the plurality of bar patterns 602 or the plurality of slant patterns 604 are not formed at mutually uniform intervals, when noise is mixed in a detection signal of the ACR test pattern, whether this is caused by the noise mixed in the detection signal or bar/slant patterns that are not formed at uniform intervals is unclear, so that noise filtering is not easy to be performed. However, as according to an embodiment, the plurality of bar patterns 602 or the plurality of slant patterns 604 may be formed at mutually uniform intervals, whereby a noise component can be easily detected. As a result, noise filtering may be readily performed.

In FIG. 6, a value obtained by dividing a circumference length (λ) of the photosensitive medium 31 by a distance between any one bar pattern 602 of a specific color and another bar pattern 602 of the same color that is closest to the one bar pattern 602 is the number of bar patterns 602 of each color within the circumference length (λ) of the photosensitive medium 31. For example, a value obtained by dividing the circumference length (λ) of the photosensitive medium 31 by a distance between the black bar pattern 602 that is positioned in the first of the bar pattern group 600 and the following black bar pattern 602 is the number of black bar patterns 602 within the circumference length (λ) of the photosensitive medium 31. When a diameter of the photosensitive medium 31 is 30 mm, the circumference length of the photosensitive medium 31 is 30π mm (approximately 94 mm), and a distance between the bar patterns 602 of the same color that are closest to each other is 15.6 mm, the number of the bar patterns 602 of the corresponding color that are formed during the single-rotation period (λ) of the photosensitive medium 31 is 6 during the single-rotation period (λ) of the photosensitive medium 31. From the ACR test pattern illustrated in FIG. 6, it can be seen that six bar patterns 602 of the same color may be formed during the single-rotation period (λ) of the photosensitive medium 31. When the number of bar patterns 602 within the single-rotation period (λ) of the photosensitive medium 31 is two or more, a sampling frequency is at least twice a fluctuation frequency of the photosensitive medium 31, thereby preventing aliasing. It can be seen that the ACR test pattern in accordance with the first embodiment illustrated in FIG. 6 satisfies this condition. Aliasing may be defined as a phenomenon in which two different sine function signals are obtained from the same signal, and that a correct signal cannot be obtained when the number of times of sampling is not sufficient. Thus, by forming as many bar patterns 602 as possible within the single-rotation period (λ) of the photosensitive medium 31, aliasing may be prevented. In FIG. 6, the circumference length of the photosensitive medium 31 is 30π, and a length Δ of the bar pattern set 606 is 30π÷6. Such conditions with respect to the bar patterns 602 may be equally applied to the slant patterns 604.

Figure 7:
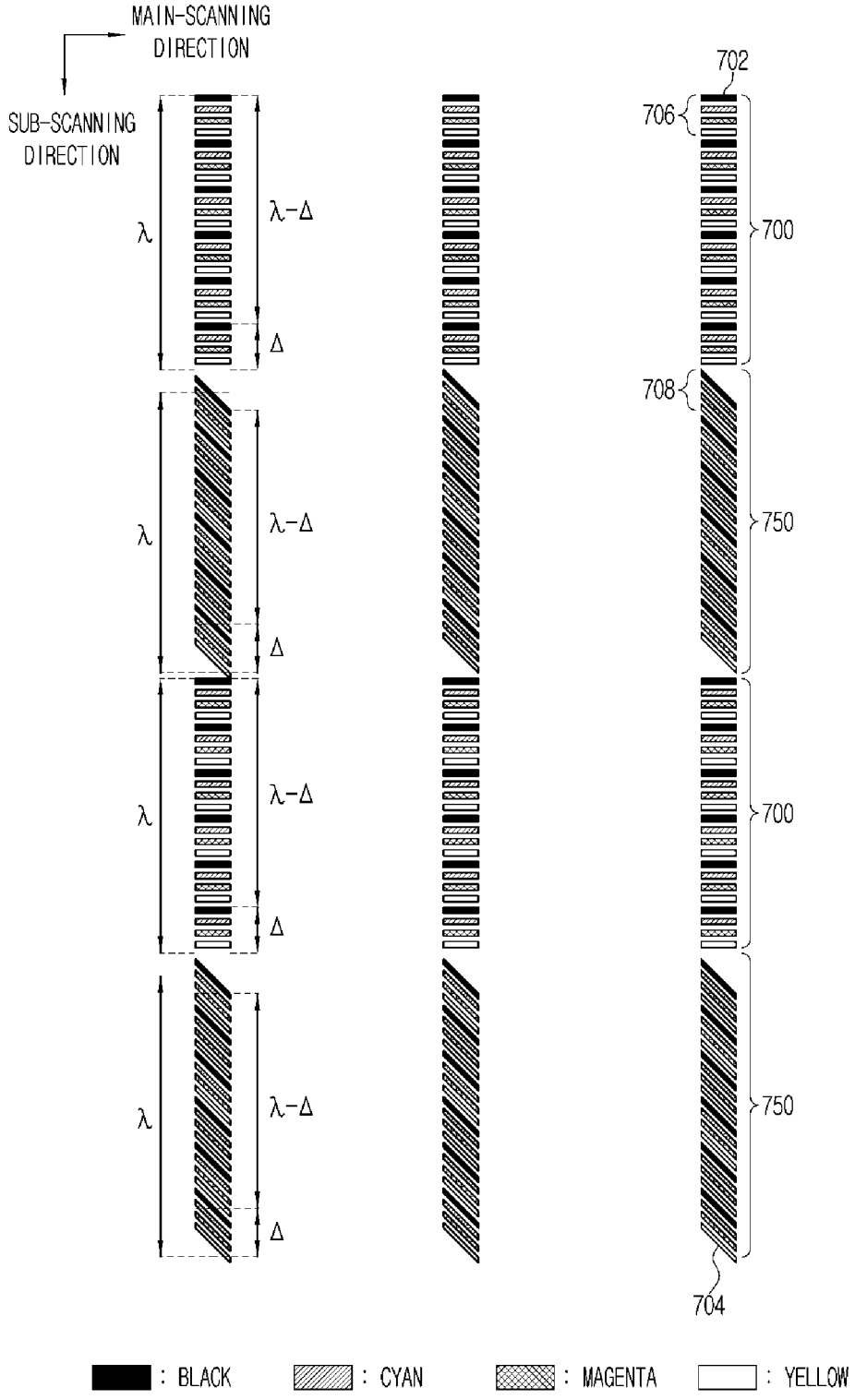
FIG. 7 illustrates an ACR test pattern in accordance with a second embodiment.

FIG. 7 illustrates an ACR test pattern in accordance with a second embodiment. In the ACR test pattern in accordance with the second embodiment, a plurality of bar patterns 702 (first patterns) are arranged in a single-row at preset intervals in the sub-scanning direction to form a single bar pattern group 700, and subsequently, a plurality of slant patterns 704 (second patterns) are arranged at preset intervals in the sub-scanning direction to form a single slant pattern group 750. The bar pattern group 700 is formed in a first region of the transfer belt 51 over a single-rotation period (λ) of the photosensitive medium 31, and the slant pattern group 750 is formed in a second region of the transfer belt 51 over another single-rotation period (λ) of the photosensitive medium 31. The bar pattern group 700 and the slant pattern group 750 are alternately arranged, whereby the ACR test pattern is formed over a four-rotation period (4λ) of the photosensitive medium 31. The single bar pattern group 700 includes at least one bar pattern set 706, and the single bar pattern set 706 includes at least one unit bar pattern 702 indicating respective colors of black, cyan, magenta, and yellow. The order in which the bar patterns 702 of black, cyan, magenta, and yellow colors are arranged for each bar pattern set 706 may be all constant. The single slant pattern group 750 also includes at least one slant pattern set 708, and the single slant pattern set 708 includes at least one unit slant pattern 704 indicating respective colors of black, cyan, magenta, and yellow. The order in which the slant patterns 704 of black, cyan, magenta, and yellow colors are arranged for each slant pattern set 708 may be all constant. The bar pattern 702 is a test pattern for color registration in the sub-scanning direction, and the slant pattern 704 is a test pattern for color registration in the main-scanning direction.

As illustrated in FIG. 7, the bar pattern group 700 includes only the plurality of bar patterns 702, and the slant pattern group 750 includes only the plurality of slant patterns 704. In this manner, the slant pattern group 750 includes only the plurality of slant patterns 704, thereby significantly reducing an area occupied by the slant patterns 704 and a time required for forming the slant patterns 704. As illustrated in FIG. 5, since the slant pattern 704 is formed to be inclined at a preset angle, the slant patterns 704 cannot be formed so as to be superimposed by interference of the bar patterns 702 when the slant patterns 704 and the bar patterns 702 are alternately arranged, and therefore the slant patterns 704 may occupy a larger area corresponding to a degree of inclination. However, as illustrated in FIG. 7, when only the plurality of slant patterns 704 make up the slant pattern group 750, neighboring slant patterns 704 can be formed to be superimposed, and therefore intervals between the slant patterns 704 may be reduced, thereby significantly reducing an area occupied by the slant pattern group 750. In other words, since a larger number of slant patterns 704 can be formed in the same area, the relatively larger number of bar patterns 702 and slant patterns 704 can be formed over a four-rotation period (4λ) of the photosensitive medium 31 as illustrated in FIG. 7 compared to the first embodiment of FIG. 6, whereby more accurate error detection and correction can be achieved.

In FIG. 7, each of the single bar pattern group 700 or the single slant pattern group 750 in the sub-scanning direction has a length corresponding to a single-rotation period (λ) (or length of a circumference of the photosensitive medium 31) of the photosensitive medium 31. That is, the plurality of bar pattern sets 706 or the plurality of slant pattern sets 708 are formed over the entire single-rotation period (λ) (or length of the circumference of the photosensitive medium 31) of the photosensitive medium 31 at uniform intervals. In FIG. 7, since the plurality of bar pattern sets 706 or the plurality of slant pattern sets 708 are formed at uniform intervals during a 360-degree period corresponding to the single-rotation period (λ) (or length of the circumference of the photosensitive medium 31) of the photosensitive medium 31, positional values of the bar patterns 702 or the slant patterns 704 are measured at uniform intervals over the entire single-rotation period of the photosensitive medium 31 and an average value of the measured values may be obtained. When this occurs, color registration correction can be more accurately performed considering a periodic fluctuation component (for example, periodic fluctuation component caused by eccentricity or deviation of the rotational speed of the photosensitive medium 31, or the like), thereby significantly improving effects of ACR. When the bar pattern set 706 or the slant pattern set 708 is formed only in a partial section of the single-rotation period of the photosensitive medium 31, an average value of the positional values of the bar patterns 702 or the slant patterns 704 is calculated without considering the periodic fluctuation component over the entire single-rotation period of the photosensitive medium 31, and therefore an error having a size corresponding to the periodic fluctuation component that is not considered may not be corrected. However, in each of the bar pattern group 700 or the slant pattern group 750 of the ACR test pattern in accordance with the second embodiment illustrated in FIG. 7, an error can be measured considering even the periodic fluctuation component over the entire single-rotation period of the photosensitive medium 31, whereby more accurate error detection and correction can be achieved.

In FIG. 7, the plurality of bar patterns 702 of the bar pattern group 700 or the plurality of slant patterns 704 of the slant pattern group 750 are all formed at uniform intervals. Due to the uniform intervals, positions of the plurality of bar patterns 702 or the plurality of slant patterns 704 can be readily detected, and it is possible to readily implement a correction algorithm for performing color registration using position data of each of the plurality of bar patterns 702 or the plurality of slant patterns 704. That is, when the plurality of bar patterns 702 or the plurality of slant patterns 704 are not formed at mutually uniform intervals, the correction algorithm should be implemented considering all intervals that are not uniform, and therefore it is very difficult to implement the correction algorithm and an amount of computation is significantly increased. However, by forming the plurality of bar patterns 702 or the plurality of slant patterns 704 at mutually uniform intervals as illustrated in the present embodiment, a simple correction algorithm having a small amount of computation may be easily implemented. In addition, it is possible to readily perform noise filtering. That is, in a case in which the plurality of bar patterns 702 or the plurality of slant patterns 704 are not formed at mutually uniform intervals, when noise is mixed in a detection signal of the ACR test pattern, whether this is caused by the noise mixed in the detection signal or bar/slant patterns that are not formed at uniform intervals is unclear, so that noise filtering is not easy to be performed. However, as illustrated in the embodiment, the plurality of bar patterns 702 or the plurality of slant patterns 704 may be formed at mutually uniform intervals, whereby a noise component can be easily detected. As a result, noise filtering may be readily performed.

In FIG. 7, a value obtained by dividing a circumference length (λ) of the photosensitive medium 31 by a distance between any one bar pattern 702 of a specific color and another bar pattern 702 of the same color that is closest to the one bar pattern 702 is the number of bar patterns 702 of each color within the circumference length (λ) of the photosensitive medium 31. For example, a value obtained by dividing the circumference length (λ) of the photosensitive medium 31 by a distance between the black bar pattern 702 that is positioned in the first of the bar pattern group 700 and the following black bar pattern 702 is the number of black bar patterns 702 within the circumference length (λ) of the photosensitive medium 31. When a diameter of the photosensitive medium 31 is 30 mm, the circumference length of the photosensitive medium 31 is 30π mm (approximately 94 mm), and a distance between the bar patterns 702 of the same color that are closest to each other is 15.6 mm, the number of the bar patterns 702 of the corresponding color that are formed during the single-rotation period (λ) of the photosensitive medium 31 is 6 during the single-rotation period (λ) of the photosensitive medium 31. From the ACR test pattern illustrated in FIG. 7, it can be seen that six bar patterns 702 of the same color are formed during the single-rotation period (λ) of the photosensitive medium 31. When the number of bar patterns 702 within the single-rotation period (λ) of the photosensitive medium 31 is two or more, a sampling frequency is at least twice the fluctuation frequency of the photosensitive medium 31, thereby preventing aliasing. It can be seen that the ACR test pattern in accordance with the second embodiment illustrated in FIG. 7 satisfies this condition. Aliasing may be defined as a phenomenon in which two different sine function signals are obtained from the same signal, and that a correct signal cannot be obtained when the number of times of sampling is not sufficient. Thus, by forming as many bar patterns 702 as possible within the single-rotation period (λ) of the photosensitive medium 31, aliasing may be prevented. In FIG. 7, the circumference length of the photosensitive medium 31 is 30π, and a length Δ of the bar pattern set 706 is 30π÷6. Such conditions with respect to the bar patterns 702 may be equally applied to the slant patterns 704.

Figure 8:
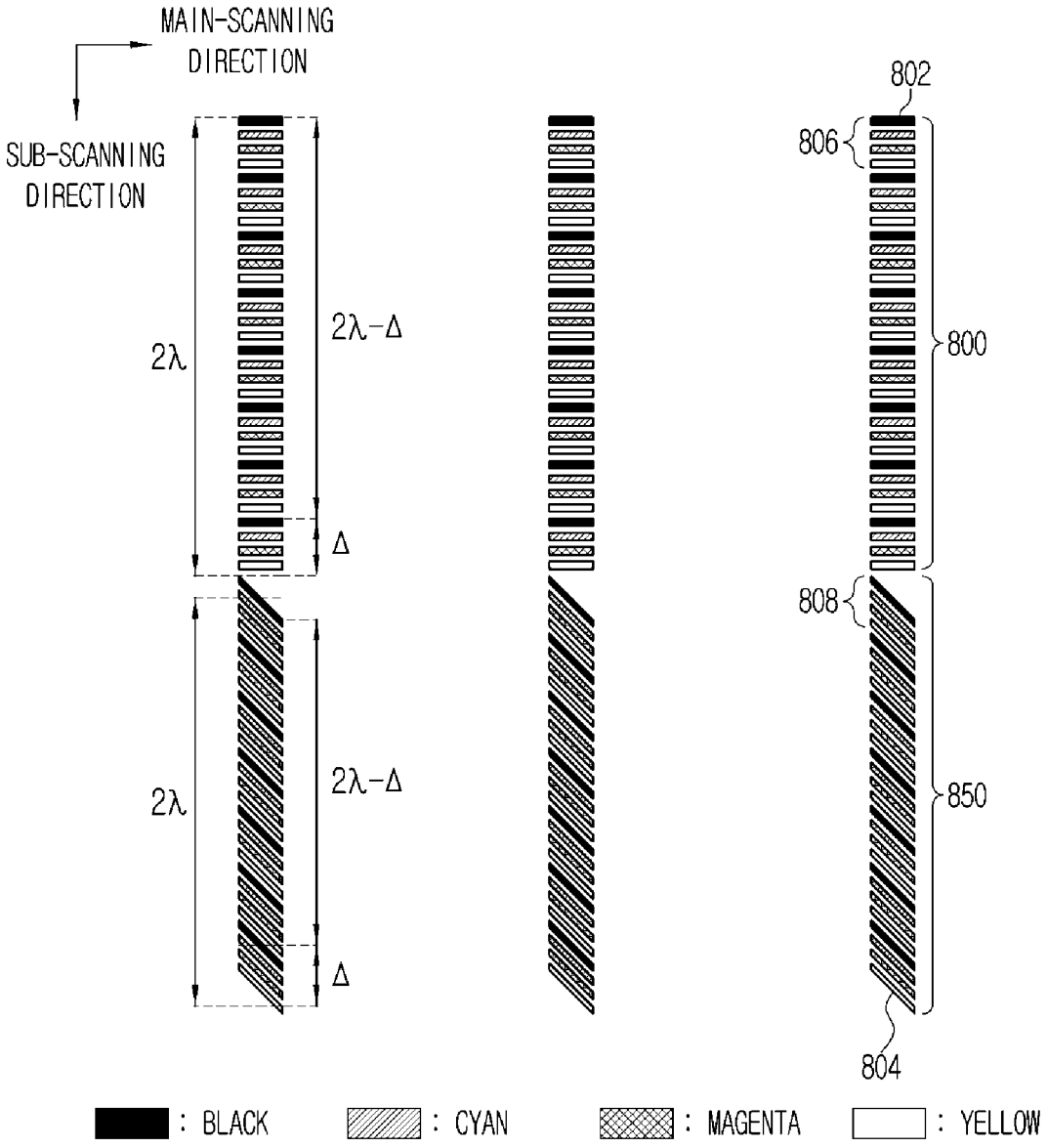
FIG. 8 illustrates an ACR test pattern in accordance with a third embodiment.

FIG. 8 illustrates an ACR test pattern in accordance with a third embodiment. In the ACR test pattern in accordance with the third embodiment illustrated in FIG. 8, a plurality of bar patterns 802 (first patterns) are arranged in a single row at preset intervals in the sub-scanning direction to form a single bar pattern group 800, and subsequently, a plurality of slant patterns 804 (second patterns) are arranged at preset intervals in the sub-scanning direction to form a single slant pattern group 850. The bar pattern group 800 is formed in a first region of the transfer belt 51 over a two-rotation period (2λ) of the photosensitive medium 31, and the slant pattern group 850 is formed in a second region of the transfer belt 51 over another two-rotation period (2λ) of the photosensitive medium 31, whereby the ACR test patterns are formed over a four-rotation period (4λ) of the photosensitive medium 31. The single bar pattern group 800 includes at least one bar pattern set 806, and the single bar pattern set 806 includes at least one unit bar pattern 802 indicating each color of black, cyan, magenta, and yellow. The order in which the bar patterns 802 of black, cyan, magenta, and yellow colors are arranged for each bar pattern set 806 is all constant. The single slant pattern group 850 also includes at least one slant pattern set 808, and the single slant pattern set 808 includes at least one unit slant pattern 804 indicating respective colors of black, cyan, magenta, and yellow. The order in which the slant patterns 804 of black, cyan, magenta, and yellow colors are arranged for each slant pattern set 808 is all constant. The bar pattern 802 is a test pattern for color registration in the sub-scanning direction, and the slant pattern 804 is a test pattern for color registration in the main-scanning direction.

As illustrated in FIG. 8, the bar pattern group 800 includes only the plurality of bar patterns 802, and the slant pattern group 850 includes only the plurality of slant patterns 804. In this manner, the slant pattern group 850 includes only the plurality of slant patterns 804, thereby significantly reducing an area occupied by the slant patterns 804 and a time required for forming the slant patterns 804. As illustrated in FIG. 5, since the slant pattern 804 is formed to be inclined at a preset angle, the slant patterns 804 cannot be formed so as to be superimposed by interference of the bar patterns 802 when the slant patterns 804 and the bar patterns 802 are alternately arranged, and therefore the slant patterns 804 may occupy a larger area corresponding to a degree of inclination. However, as illustrated in FIG. 8, when only the plurality of slant patterns 804 make up the slant pattern group 850, neighboring slant patterns 804 can be formed to be superimposed, and therefore intervals between the slant patterns 804 may be reduced, thereby significantly reducing an area occupied by the slant pattern group 850. In other words, since a larger number of slant patterns 804 can be formed in the same area, the relatively larger number of bar patterns 802 and slant patterns 804 can be formed over a four-rotation period (4λ) of the photosensitive medium 31 as illustrated in FIG. 8 compared to the first embodiment of FIG. 6, whereby more accurate error detection and correction can be achieved.

In FIG. 8, each of the single bar pattern group 800 or the single slant pattern group 850 in the sub-scanning direction has a length corresponding to a single-rotation period (λ) (or length of a circumference of the photosensitive medium 31) of the photosensitive medium 31. That is, the plurality of bar pattern sets 806 or the plurality of slant pattern sets 808 are formed over the entire single-rotation period (λ) (or length of the circumference of the photosensitive medium 31) of the photosensitive medium 31 at uniform intervals. In FIG. 8, since the plurality of bar pattern sets 806 or the plurality of slant pattern sets 808 are formed at uniform intervals during a 360-degree period corresponding to the single-rotation period (λ) (or length of the circumference of the photosensitive medium 31) of the photosensitive medium 31, positional values of the bar patterns 802 or the slant patterns 804 are measured at uniform intervals over the entire single-rotation period of the photosensitive medium 31 and an average value of the measured values may be obtained. For example, in a case of black, the bar patterns 802 and the slant patterns 804 are positioned in 0, 90, 180, 270, 360, 450, 540, and 630 degrees, respectively, and an average value (median value) obtained by calculating the average of respective positional values of the bar patterns 802 and the slant patterns 804 is all zero, and therefore an accurate median value can be calculated even though there is a periodic fluctuation component. When this occurs, color registration correction can be more accurately performed considering the periodic fluctuation component (for example, periodic fluctuation component caused by eccentricity or deviation of the rotational speed of the photosensitive medium 31, or the like), thereby significantly improving effects of ACR. When the bar pattern set 806 or the slant pattern set 808 is formed only in a partial section of the single-rotation period of the photosensitive medium 31, an average value of the positional values of the bar patterns 802 or the slant patterns 804 is calculated without considering the periodic fluctuation component over the entire single-rotation period of the photosensitive medium 31, and therefore an error having a size corresponding to the periodic fluctuation component that is not considered may not be corrected. However, in each of the bar pattern group 800 or the slant pattern group 850 of the ACR test pattern in accordance with the third embodiment illustrated in FIG. 8, an error can be measured considering even the periodic fluctuation component over the entire single-rotation period of the photosensitive medium 31, whereby more accurate error detection and correction can be achieved.

In FIG. 8, the plurality of bar patterns 802 of the bar pattern group 800 or the plurality of slant patterns 804 of the slant pattern group 850 are all formed at uniform intervals. Due to the uniform intervals, positions of the plurality of bar patterns 802 or the plurality of slant patterns 804 can be readily detected, and it is possible to readily implement a correction algorithm for performing color registration using position data of each of the plurality of bar patterns 802 or the plurality of slant patterns 804. That is, when the plurality of bar patterns 802 or the plurality of slant patterns 804 are not formed at mutually uniform intervals, the correction algorithm should be implemented considering all intervals that are not uniform, and therefore it is very difficult to implement the correction algorithm and an amount of computation is significantly increased. However, by forming the plurality of bar patterns 802 or the plurality of slant patterns 804 at mutually uniform intervals as illustrated in the present embodiment, a simple correction algorithm having a small amount of computation may be easily implemented. In addition, it is possible to readily perform noise filtering. That is, in a case in which the plurality of bar patterns 802 or the plurality of slant patterns 804 are not formed at mutually uniform intervals, when noise is mixed in a detection signal of the ACR test pattern, whether this is caused by the noise mixed in the detection signal or bar/slant patterns that are not formed at uniform intervals is unclear, so that noise filtering is not easy to be performed. However, as illustrated in the embodiment, the plurality of bar patterns 802 or the plurality of slant patterns 804 are formed at mutually uniform intervals, whereby a noise component can be easily detected. As a result, noise filtering may be readily performed.

In FIG. 8, a value obtained by dividing a circumference length (λ) of the photosensitive medium 31 by a distance between any one bar pattern 802 of a specific color and another bar pattern 802 of the same color that is closest to the one bar pattern 802 is the number of bar patterns 802 of each color within the circumference length (λ) of the photosensitive medium 31. For example, a value obtained by dividing the circumference length (λ) of the photosensitive medium 31 by a distance between the black bar pattern 802 that is positioned in the first of the bar pattern group 800 and the following black bar pattern 802 is the number of black bar patterns 802 within the circumference length (λ) of the photosensitive medium 31. When a diameter of the photosensitive medium 31 is 30 mm, the circumference length of the photosensitive medium 31 is 30π mm (approximately 94 mm), and a distance between the bar patterns 802 of the same color that are closest to each other is 11.7 mm, the number of the bar patterns 802 of the corresponding color that are formed during the single-rotation period (λ) of the photosensitive medium 31 is 8 during the two-rotation period (2λ) of the photosensitive medium 31. From the ACR test pattern illustrated in FIG. 8, it can be seen that eight bar patterns 802 of the same color are formed during the two-rotation period (2λ) of the photosensitive medium 31. When the number of bar patterns 802 within the single-rotation period (λ) of the photosensitive medium 31 is two or more, a sampling frequency is at least twice the fluctuation frequency of the photosensitive medium 31, thereby preventing aliasing. It can be seen that the ACR test pattern in accordance with the third embodiment illustrated in FIG. 8 satisfies this condition. Aliasing may be defined as a phenomenon in which two different sine function signals are obtained from the same signal, and that a correct signal cannot be obtained when the number of times of sampling is not sufficient. Thus, by forming as many bar patterns 802 as possible within the single-rotation period (λ) of the photosensitive medium 31, aliasing may be prevented. In FIG. 8, the circumference length of the photosensitive medium 31 is 30π, and a length Δ of the bar pattern set 806 is 30π÷6. Such conditions with respect to the bar patterns 802 may be equally applied to the slant patterns 804.

Figure 9:
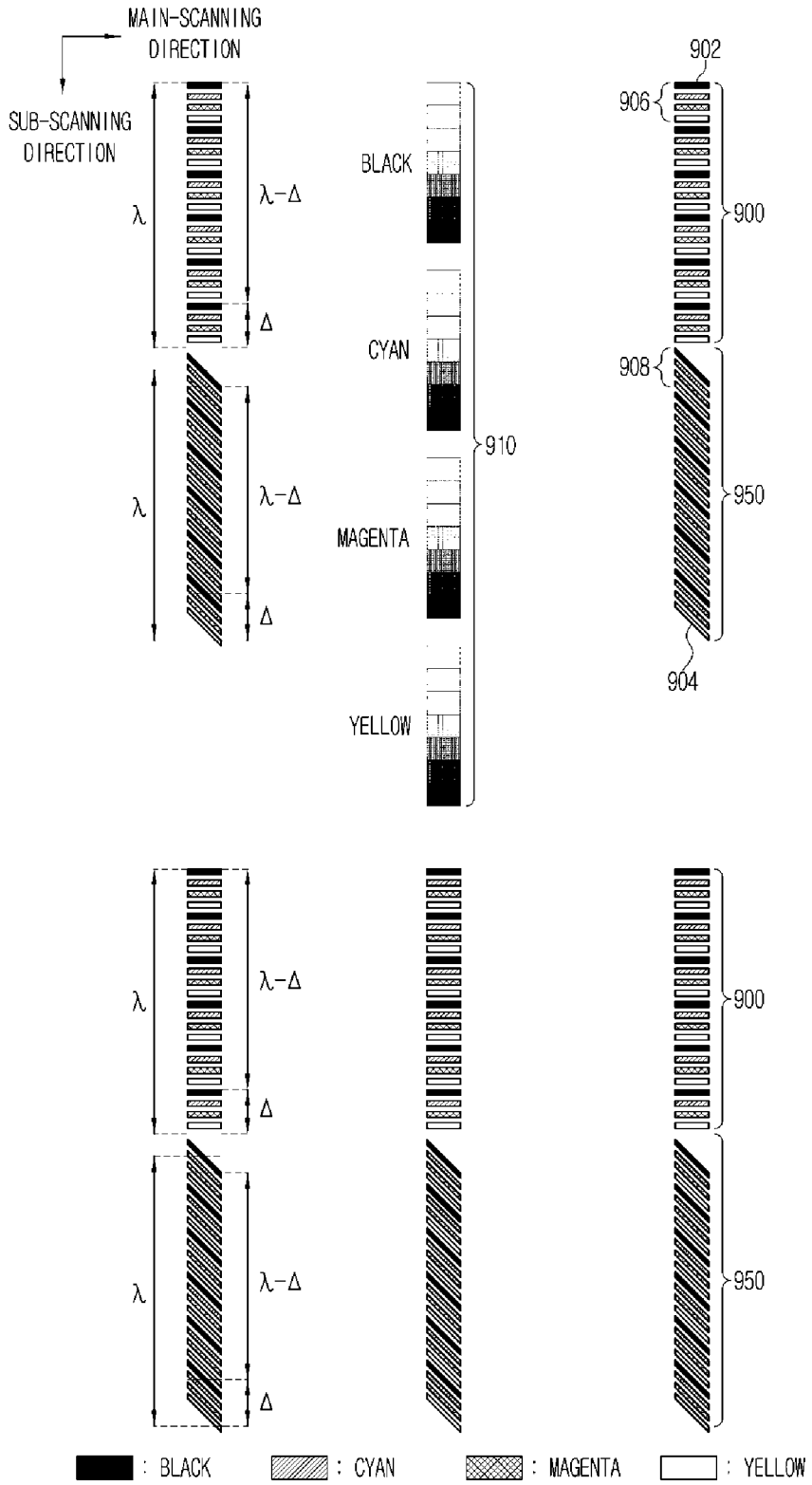
FIG. 9 illustrates an ACR test pattern in accordance with a fourth embodiment.

FIG. 9 illustrates an ACR test pattern in accordance with a fourth embodiment. In the ACR test pattern in accordance with the fourth embodiment, a plurality of bar patterns 902 (first patterns) are arranged in a single-row at preset intervals in the sub-scanning direction to form a single bar pattern group 900, and subsequently, a plurality of slant patterns 904 (second patterns) are arranged at preset intervals in the sub-scanning direction to form a single slant pattern group 950. The bar pattern group 900 is formed in a first region of the transfer belt 51 over a single-rotation period (λ) of the photosensitive medium 31, and the slant pattern group 950 is formed in the first region of the transfer belt 51 over another single-rotation period (λ) of the photosensitive medium 31.

The bar pattern group 900 and the slant pattern group 950 are alternately arranged, whereby the ACR test pattern is formed over a four-rotation period (4λ) of the photosensitive medium 31. The single bar pattern group 900 includes at least one bar pattern set 906, and the single bar pattern set 906 includes at least one unit bar pattern 902 indicating respective colors of black, cyan, magenta, and yellow. The order in which the bar patterns 902 of black, cyan, magenta, and yellow colors are arranged for each bar pattern set 906 is all constant. The single slant pattern group 950 also includes at least one slant pattern set 908, and the single slant pattern set 908 includes at least one unit slant pattern 904 indicating respective colors of black, cyan, magenta, and yellow. The order in which the slant patterns 904 of black, cyan, magenta, and yellow colors are arranged for each slant pattern set 908 is all constant. The bar pattern 902 is a test pattern for color registration in the sub-scanning direction, and the slant pattern 904 is a test pattern for color registration in the main-scanning direction.

In FIG. 9, a color density correction test pattern 910 is provided between the left and right ACR test patterns 900 and 950. The color density correction test pattern 910 is formed to have a plurality of preset levels of densities ranging from high density to low density for each color of black, cyan, magenta, and yellow (gradation processing). When the color density correction test pattern 910 is detected through the test pattern detection unit 59 and the plurality of preset levels of densities are formed as is, it can be seen that normal density representation is achieved. When the density of the color density correction test pattern 910 is different from the plurality of preset levels of the densities, the plurality of preset levels of the densities are formed through density correction by detecting a difference between the densities. According to the fourth embodiment illustrated in FIG. 9, the ACR test patterns 900 and 950 and the color density correction test pattern 910 are arranged side by side, and therefore the color registration correction and color density correction may be simultaneously performed. As a result, a correction time can be significantly shortened compared to a case in which the color registration correction and the density correction are sequentially performed.

As illustrated in FIG. 9, the bar pattern group 900 includes only the plurality of bar patterns 902, and the slant pattern group 950 includes only the plurality of slant patterns 904. The slant pattern group 950 includes only the plurality of slant patterns 904, thereby significantly reducing an area occupied by the slant patterns 904 and a time required for forming the slant patterns 904. As described in FIG. 5, since the slant pattern 904 is formed to be inclined at a preset angle, the slant patterns 904 cannot be formed so as to be superimposed by interference of the bar patterns 902 when the slant patterns 904 and the bar patterns 902 are alternately arranged, and therefore the slant patterns 904 may occupy a larger area corresponding to a degree of inclination. However, as illustrated in FIG. 9, when only the plurality of slant patterns 904 make up the slant pattern group 950, neighboring slant patterns 904 can be formed to be superimposed, and therefore intervals between the slant patterns 904 may be reduced, thereby significantly reducing an area occupied by the slant pattern group 950. In other words, since a larger number of slant patterns 904 can be formed in the same area, the relatively larger number of bar patterns 902 and slant patterns 904 can be formed over a four-rotation period (4λ) of the photosensitive medium 31 as illustrated in FIG. 9 compared to the first embodiment of FIG. 6, whereby more accurate error detection and correction can be achieved.

In FIG. 9, each of the single bar pattern group 900 or the single slant pattern group 950 in the sub-scanning direction has a length corresponding to a single-rotation period (λ) (or length of a circumference of the photosensitive medium 31) of the photosensitive medium 31. That is, the plurality of bar pattern sets 906 or the plurality of slant pattern sets 908 are formed over the entire single-rotation period (λ) (or length of the circumference of the photosensitive medium 31) of the photosensitive medium 31 at uniform intervals. In FIG. 9, since the plurality of bar pattern sets 906 or the plurality of slant pattern sets 908 are formed at uniform intervals during a 360-degree period corresponding to the single-rotation period (λ) (or length of the circumference of the photosensitive medium 31) of the photosensitive medium 31, positional values of the bar patterns 902 or the slant patterns 904 are measured at uniform intervals over the entire single-rotation period of the photosensitive medium 31 and an average value of the measured values may be obtained. When this occurs, color registration correction can be more accurately performed considering a periodic fluctuation component (for example, periodic fluctuation component caused by eccentricity or deviation of the rotational speed of the photosensitive medium 31, or the like), thereby significantly improving effects of ACR. When the bar pattern set 906 or the slant pattern set 908 is formed only in a partial section of the single-rotation period of the photosensitive medium 31, an average value of the positional values of the bar patterns 902 or the slant patterns 904 is calculated without considering the periodic fluctuation component over the entire single-rotation period of the photosensitive medium 31, and therefore an error having a size corresponding to the periodic fluctuation component that is not considered may not be corrected. However, in each of the bar pattern group 900 or the slant pattern group 950 of the ACR test pattern in accordance with the fourth embodiment illustrated in FIG. 9, an error can be measured considering even the periodic fluctuation component over the entire single-rotation period of the photosensitive medium 31, whereby more accurate error detection and correction can be achieved.

In FIG. 9, the plurality of bar patterns 902 constituting the bar pattern group 900 or the plurality of slant patterns 904 constituting the slant pattern group 950 are all formed at uniform intervals. Due to the uniform intervals, positions of the plurality of bar patterns 902 or the plurality of slant patterns 904 can be readily detected, and obviously, it is possible to readily implement a correction algorithm for performing color registration using position data of each of the plurality of bar patterns 902 or the plurality of slant patterns 904. That is, when the plurality of bar patterns 902 or the plurality of slant patterns 904 are not formed at mutually uniform intervals, the correction algorithm should be implemented considering all intervals that are not uniform, and therefore it is very difficult to implement the correction algorithm and an amount of computation is significantly increased. However, by forming the plurality of bar patterns 902 or the plurality of slant patterns 904 at mutually uniform intervals as illustrated in the present embodiment, a simple correction algorithm having a small amount of computation may be easily implemented. In addition, it is possible to readily perform noise filtering. That is, in a case in which the plurality of bar patterns 902 or the plurality of slant patterns 904 are not formed at mutually uniform intervals, when noise is mixed in a detection signal of the ACR test pattern, whether this is caused by the noise mixed in the detection signal or bar/slant patterns that are not formed at uniform intervals is unclear, so that noise filtering is not easy to be performed. However, as illustrated in the embodiment, the plurality of bar patterns 902 or the plurality of slant patterns 904 are formed at mutually uniform intervals, whereby a noise component can be easily detected. As a result, noise filtering may be readily performed.

In FIG. 9, a value obtained by dividing a circumference length (λ) of the photosensitive medium 31 by a distance between any one bar pattern 902 of a specific color and another bar pattern 902 of the same color that is closest to the one bar pattern 902 is the number of bar patterns 902 of each color within the circumference length (λ) of the photosensitive medium 31. For example, a value obtained by dividing the circumference length (λ) of the photosensitive medium 31 by a distance between the black bar pattern 902 that is positioned in the first of the bar pattern group 900 and the following black bar pattern 902 is the number of black bar patterns 902 within the circumference length (λ) of the photosensitive medium 31. When a diameter of the photosensitive medium 31 is 30 mm, the circumference length of the photosensitive medium 31 is 30π mm (approximately 94 mm), and a distance between the bar patterns 902 of the same color that are closest to each other is 15.6 mm, the number of the bar patterns 902 of the corresponding color that are formed during the single-rotation period (λ) of the photosensitive medium 31 is 6 during the single-rotation period (λ) of the photosensitive medium 31. From the ACR test pattern illustrated in FIG. 9, it can be seen that six bar patterns 902 of the same color are formed during the single-rotation period (λ) of the photosensitive medium 31. When the number of bar patterns 902 within the single-rotation period (λ) of the photosensitive medium 31 is two or more, a sampling frequency is at least twice the fluctuation frequency of the photosensitive medium 31, thereby preventing aliasing. It can be seen that the ACR test pattern in accordance with the fourth embodiment illustrated in FIG. 9 satisfies this condition. Aliasing may be defined as a phenomenon in which two different sine function signals are obtained from the same signal, and that a correct signal cannot be obtained when the number of times of sampling is not sufficient. Thus, by forming as many bar patterns 902 as possible within the single-rotation period (λ) of the photosensitive medium 31, aliasing may be prevented. In FIG. 9, the circumference length of the photosensitive medium 31 is 30π, and a length Δ of the bar pattern set 906 is 30π÷6. Such conditions with respect to the bar patterns 902 may be equally applied to the slant patterns 904.

Figure 10:
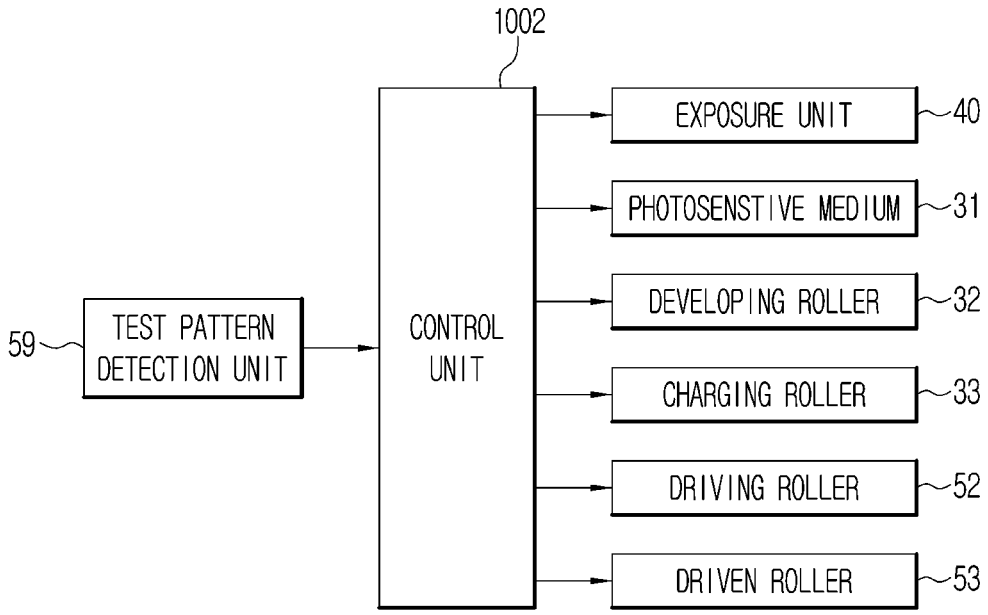
FIG. 10 illustrates a control system of an image forming apparatus in accordance with an embodiment.

FIG. 10 illustrates a control system of an image forming apparatus in accordance with an embodiment. As illustrated in FIG. 10, the test pattern detection unit 59 is communicably and electrically connected to an input side of a control unit 1002 for controlling overall operations of the image forming apparatus 100 to provide a test pattern detection result to the control unit 1002. The exposure unit 40, the photosensitive medium 31, the developing roller 32, the charging roller 33, the driving roller 52, and the driven roller 53 are connected to the input side of the control unit 1002 through a driving unit or the like so that the exposure unit 40, the photosensitive medium 31, the developing roller 32, the charging roller 33, the driving roller 52, and the driven roller 53 can be controlled. The control unit 1002 controls the exposure unit 40, the photosensitive medium 31, the developing roller 32, and the charging roller 33 to perform exposure and developing, and controls the driving roller 52 and the driven roller 53 to drive the transfer belt 51 that is an intermediate transfer body, so that an image is formed on the transfer belt 51 by controlling the transfer belt 51, the photosensitive medium 31, and the like. In particular, the ACR test pattern in accordance with an embodiment is formed on the transfer belt 51.

Figure 11:
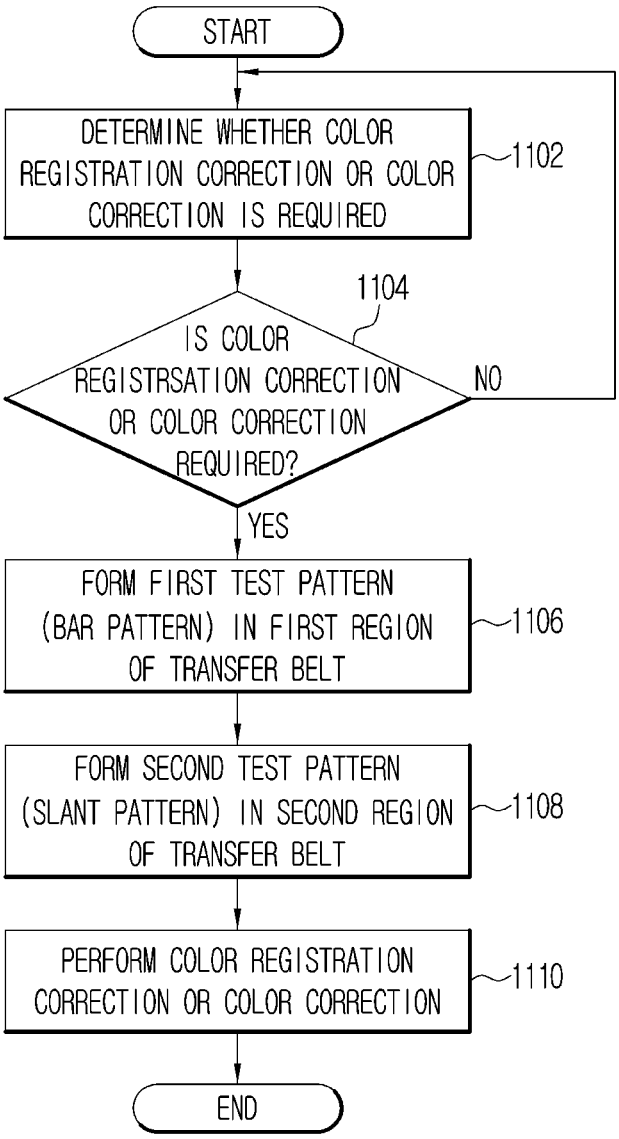
FIG. 11 illustrates a control method of an image forming apparatus in accordance with an embodiment.

FIG. 11 illustrates a control method of an image forming apparatus in accordance with an embodiment. As illustrated in FIG. 11, in operation 1102, the control unit 1002 of the image forming apparatus 100 determines whether color registration correction or color correction is required in the current image forming apparatus 100. The color registration correction or the color correction may be periodically performed, or performed based on changes in surrounding environment such as a temperature, humidity, and the like, as necessary. In operation 1106, when it is determined that the color registration correction or the color correction is required ("yes" of operation 1104), the control unit 1002 controls the exposure unit 40, the photosensitive medium 31, the developing roller 32, and the charging roller 33 to perform exposure and developing, and controls the driving roller 52 and the driven roller 53 to drive the transfer belt 51 that is the intermediate transfer body, so that first patterns (bar patterns) are formed in the first region of the transfer belt 51 by controlling the transfer belt 51, the photosensitive medium 31, and the like. In operation 1108, the control unit 1002 controls the exposure unit 40, the photosensitive medium 31, the developing roller 32, and the charging roller 33 to perform exposure and developing, and controls the driving roller 52 and the driven roller 53 to drive the transfer belt 51 that is the intermediate transfer body, so that second patterns (slant patterns) are formed in the second region of the transfer belt 51 by controlling the transfer belt 51, the photosensitive medium 31, and the like. In operation 1110, when formation of the first and second patterns is completed, the first patterns (bar patterns) and the second patterns (slant patterns) are detected through the test pattern detection unit 59, and the color registration correction and the color correction are performed based on the detection result.

As described above, according to the embodiments, a time required for color registration may be reduced by minimizing a region in which the color registration test pattern is formed on the intermediate transfer body.

In addition, the color density test pattern together with the color registration test pattern may be formed on the intermediate transfer body so that color registration correction and color density correction may be simultaneously performed, thereby reducing a time required for the color registration correction and the color density correction.

In addition, an error of the color registration may be reduced through improvement of the color registration test pattern, thereby improving accuracy.

Although a few embodiments have been illustrated and described, it would be appreciated by those skilled in the art that changes may be made in these embodiments without departing from the principles and spirit of the invention, the scope of that is defined in the claims and their equivalents.

What is claimed is:

1. A control method of an image forming apparatus that includes a plurality of photosensitive media arranged side by side to correspond to a plurality of colors in a rotation direction of an intermediate transfer body, the control method comprising:

forming a plurality of first patterns of the plurality of colors arranged in a single row in a sub-scanning direction in a first region of the intermediate transfer body over a single-rotation period of the photosensitive media; and forming a plurality of second patterns of the plurality of colors arranged in a single row in the sub-scanning direction in a second region of the intermediate transfer body over another single-rotation period of the photosensitive media, wherein the forming of the plurality of first patterns includes repeatedly forming first unit patterns of the plurality of colors in a preset order; and the forming of the plurality of second patterns includes repeatedly forming second unit patterns of the plurality of colors in a preset order.

2. The control method according to claim 1, wherein the forming of the plurality of first patterns includes repeatedly forming the first unit patterns of the plurality of colors at least twice, and the forming of the plurality of second patterns includes repeatedly forming the second unit patterns of the plurality of colors at least twice.

3. The control method according to claim 1, wherein the plurality of colors includes black, cyan, magenta, and yellow.

4. The control method according to claim 1, wherein the forming of the plurality of first patterns includes forming the plurality of first patterns at uniform intervals, and the forming of the plurality of second patterns includes forming the plurality of second patterns at uniform intervals.

5. The control method according to claim 1, wherein the first patterns are patterns for color arrangement in the sub-scanning direction.

6. The control method according to claim 5, wherein the first patterns are bar-patterns that are formed long in a main-scanning direction.

7. The control method according to claim 1, wherein the second patterns are patterns for color arrangement in the main-scanning direction.

8. The control method according to claim 7, wherein the second patterns are slant patterns that are formed to be inclined in the sub-scanning direction.

9. A control method of an image forming apparatus that includes a plurality of photosensitive media arranged side by side to correspond to a plurality of colors in a rotation direction of an intermediate transfer body, the control method comprising:

forming a plurality of first patterns of the plurality of colors arranged in a single row in a sub-scanning direction in a first region of the intermediate transfer body over a single-rotation period of the photosensitive media;

forming a plurality of second patterns of the plurality of colors arranged in a single row in the sub-scanning direction in a second region of the intermediate transfer body over another single-rotation period of the photosensitive media; and alternately forming the plurality of first patterns and the plurality of second patterns over a four-rotation period of the photosensitive media.

10. The control method according to claim 9, wherein the forming of the plurality of first patterns includes repeatedly forming first unit patterns of the plurality of colors in a preset order, and the forming of the plurality of second patterns includes repeatedly forming second unit patterns of the plurality of colors in a preset order.

11. The control method according to claim 10, wherein the forming of the plurality of first patterns includes repeatedly forming the first unit patterns of the plurality of colors at least twice, and the forming of the plurality of second patterns includes repeatedly forming the second unit patterns of the plurality of colors at least twice.

12. The control method according to claim 9, wherein the plurality of colors includes black, cyan, magenta, and yellow.

13. The control method according to claim 9, wherein the forming of the plurality of first patterns includes forming the plurality of first patterns at uniform intervals, and the forming of the plurality of second patterns includes forming the plurality of second patterns at uniform intervals.

14. The control method according to claim 9, wherein the first patterns are patterns for color arrangement in the sub-scanning direction.

15. The control method according to claim 14, wherein the first patterns are bar-patterns that are formed long in a main-scanning direction.

16. The control method according to claim 9, wherein the second patterns are patterns for color arrangement in the main-scanning direction.

17. The control method according to claim 16, wherein the second patterns are slant patterns that are formed to be inclined in the sub-scanning direction.

18. A control method of an image forming apparatus that includes a plurality of photosensitive media arranged side by side to correspond to a plurality of colors in a rotation direction of an intermediate transfer body, the control method comprising:

forming a plurality of first patterns of the plurality of colors arranged in a single row in a sub-scanning direction in a first region of the intermediate transfer body over a two-rotation period of the photosensitive media; and forming a plurality of second patterns of the plurality of colors arranged in a single row in the sub-scanning direction in a second region of the intermediate transfer body over another two-rotation period of the photosensitive media.

19. The control method according to claim 18, wherein the forming of the plurality of first patterns includes repeatedly forming first unit patterns of the plurality of colors in a preset order, and the forming of the plurality of second patterns includes repeatedly forming second unit patterns of the plurality of colors in a preset order.

20. The control method according to claim 19, wherein the forming of the plurality of first patterns includes repeatedly forming the first unit patterns of the plurality of colors at least twice, and the forming of the plurality of second patterns includes repeatedly forming the second unit patterns of the plurality of colors at least twice.

21. The control method according to claim 18, wherein the plurality of colors includes black, cyan, magenta, and yellow.

22. The control method according to claim 18, wherein the forming of the plurality of first patterns includes forming the plurality of first patterns at uniform intervals, and the forming of the plurality of second patterns includes forming the plurality of second patterns at uniform intervals.

23. The control method according to claim 18, wherein the first patterns are patterns for color arrangement in the sub-scanning direction.

24. The control method according to claim 23, wherein the first patterns are bar-patterns that are formed long in a main-scanning direction.

25. The control method according to claim 18, wherein the second patterns are patterns for color arrangement in the main-scanning direction.

26. The control method according to claim 25, wherein the second patterns are slant patterns that are formed to be inclined in the sub-scanning direction.

27. A control method of an image forming apparatus that includes a plurality of photosensitive media arranged side by side to correspond to a plurality of colors in a rotation direction of an intermediate transfer body, the control method comprising:

forming a plurality of first patterns of the plurality of colors arranged in a single row in a sub-scanning direction in a first region of the intermediate transfer body over a single-rotation period of the photosensitive media;

forming a plurality of second patterns of the plurality of colors arranged in a single row in the sub-scanning direction in a second region of the intermediate transfer body over another single-rotation period of the photosensitive media;

alternately forming the plurality of first patterns and the plurality of second patterns over a four-rotation period of the photosensitive media; and forming a color density test pattern side by side with the plurality of first patterns or the plurality of second patterns in the sub-scanning direction.

28. The control method according to claim 27, wherein the forming of the plurality of first patterns includes repeatedly forming first unit patterns of the plurality of colors in a preset order, and the forming of the plurality of second patterns includes repeatedly forming second unit patterns of the plurality of colors in a preset order.

29. The control method according to claim 28, wherein the forming of the plurality of first patterns includes repeatedly forming the first unit patterns of the plurality of colors at least twice, and the forming of the plurality of second patterns includes repeatedly forming the second unit patterns of the plurality of colors at least twice.

30. The control method according to claim 27, wherein the plurality of colors includes black, cyan, magenta, and yellow.

31. The control method according to claim 27, wherein the forming of the plurality of first patterns includes forming the plurality of first patterns at uniform intervals, and the forming of the plurality of second patterns includes forming the plurality of second patterns at uniform intervals.

32. The control method according to claim 27, wherein the first patterns are patterns for color arrangement in the sub-scanning direction.

33. The control method according to claim 32, wherein the first patterns are bar-patterns that are formed long in a main-scanning direction.

34. The control method according to claim 27, wherein the second patterns are patterns for color arrangement in the main-scanning direction.

35. The control method according to claim 33, wherein the second patterns are slant patterns that are formed to be inclined in the sub-scanning direction.

36. A control method of an image forming apparatus comprising:

forming a plurality of first patterns of a plurality of colors arranged in a single row in a sub-scanning direction in a first region of an intermediate transfer body over at least a single-rotation period of photosensitive media; and forming a plurality of second patterns of the plurality of colors arranged in a single row in the sub-scanning direction in a second region of the intermediate transfer body over at least another single-rotation period of the photosensitive media, wherein the forming of the plurality of first patters includes repeatedly forming first unit patterns of the plurality of colors in a preset order; and the forming of the plurality of second patterns includes repeatedly forming second unit patters of the plurality of colors in a preset order.

37. An image forming apparatus comprising:

an intermediate transfer body in which an image is formed;

a plurality of photosensitive media that are arranged side by side to correspond to a plurality of colors in a rotation direction of the intermediate transfer body; and a control unit that controls the intermediate transfer body and the plurality of photosensitive media so that a plurality of first patterns of the plurality of colors arranged in a single row in a sub-scanning direction are formed in a first region of the intermediate transfer body over at least a single-rotation period of the photosensitive media and a plurality of second patterns of the plurality of colors arranged in a single row in the sub-scanning direction are formed in a second region of the intermediate transfer body over at least another single-rotation period of the photosensitive media, wherein the forming of the plurality of first patterns includes repeatedly forming first unit patterns of the plurality of colors in a preset order; and the forming of the plurality of second patterns includes repeatedly forming second unit patterns of the plurality of colors in a preset order.

* * * * *